US006622852B2

(12) United States Patent
Tsutsui

(10) Patent No.: US 6,622,852 B2
(45) Date of Patent: Sep. 23, 2003

(54) CONTINUOUS CONTAINER-SUPPLYING APPARATUS

(75) Inventor: Shoji Tsutsui, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 0 days.

(21) Appl. No.: 09/892,925

(22) Filed: Jun. 26, 2001

(65) Prior Publication Data

US 2001/0054541 A1 Dec. 27, 2001

(30) Foreign Application Priority Data

Jun. 26, 2000 (JP) ..... 2000-191781

(51) Int. Cl.[7] ..... B65G 19/24

(52) U.S. Cl. ..... 198/731; 198/626.5; 198/867.05

(58) Field of Search ..... 198/606, 626.3, 198/626.5, 731, 867.08; 53/562, 570, 249, 257

(56) References Cited

U.S. PATENT DOCUMENTS

| | | | | |
|---|---|---|---|---|
| 4,642,975 A | | 2/1987 | Langen et al. | |
| 4,982,556 A | * | 1/1991 | Tisma | 198/867.08 X |
| 5,328,021 A | * | 7/1994 | Calvert et al. | 198/731 X |
| 5,546,734 A | * | 8/1996 | Moncrief et al. | 198/731 X |
| 5,901,832 A | * | 5/1999 | Woolley et al. | 198/626.3 |
| 6,024,207 A | * | 2/2000 | Looser et al. | 198/867.08 X |
| 6,260,690 B1 | * | 7/2001 | Batzer | 198/626.5 |

FOREIGN PATENT DOCUMENTS

| | | |
|---|---|---|
| EP | 1 035 023 A1 | 9/2000 |
| FR | 1 139 611 | 7/1957 |
| GB | 935 377 | 8/1963 |
| JP | H2-296617 | 12/1990 |
| JP | H6-211213 | 8/1994 |
| JP | H8-337217 | 12/1996 |
| JP | H10-310230 | 11/1998 |
| JP | H11-268817 | 10/1999 |
| JP | H11-310208 | 11/1999 |
| JP | H2000-053235 | 2/2000 |
| JP | H2000-109021 | 4/2000 |

* cited by examiner

*Primary Examiner*—James R. Bidwell
(74) *Attorney, Agent, or Firm*—Koda & Androlia

(57) ABSTRACT

A continuous container-supplying apparatus in which a plurality of container holding assemblies, each comprising right-side and left-side holding members are provided on conveyor belts that run as an integral unit along an annular track that has a pair of parallel sections. Containers are intermittently supplied to the container holding assemblies on one side of the parallel sections, and then converted into a continuous movement in a single row on another side of the parallel sections so that containers are continuously supplied to a filling and packaging system. The right-side holding members are provided on the upper conveyor belt, and the left-side holding members are provided on the conveyor belt. When containers of different width are to be supplied, the relative positional relationship of the upper and lower conveyor belts in the conveying direction is adjusted so as to change the spacing between the right-side and left-side holding members.

3 Claims, 15 Drawing Sheets

CONTINUOUS CONTAINER-SUPPLYING APPARATUS

BACKGROUND OF THE INVENTION

1. Field of the Invention

The present invention relates to a continuous container-supplying apparatus and more particularly to an improvement in a continuous container-supplying apparatus used in a continuous filling and packaging system in which various packaging operations such as filling with contents, sealing of the openings of containers, etc. are performed on containers (e.g., packaging bags) while the containers are continuously conveyed at a high speed.

2. Prior Art

The continuous bag-supplying apparatus shown in FIGS. 11 through 13 is described in the U.S. patent application Ser. No. 09/523,856 which is filed by the applicant of the present patent application.

The continuous bag-supplying apparatus 1 comprises a bag holding assembly conveying device 4 which has a plurality of bag holding assemblies 3 attached at equal intervals to a conveyor belt 2, and an intermittent bag-supplying device 5 which simultaneously supplies bags to a plurality of the bag holding assemblies 3 (i.e., to n number of bag holding assemblies 3), with one bag being supplied to each bag holding assembly 3. The bag holding assembly 3 is moved in one direction along an annular track that has a pair parallel sections.

The bag holding assemblies 3 are moved intermittently on one side (the bag entry side) A of the parallel sections, with each movement covering a distance that is n times the attachment spacing of the bag holding assemblies 3, and the bag holding assemblies 3 move are further continuously at a constant speed on the other side (bag exit side) B of the parallel sections.

The intermittent bag-supplying device 5 is disposed on the bag entry side A so as to supply bags in a plurality of rows (n rows) to stopped bag holding assemblies 3. On the bag exit side B, a rotary type transfer device 6 is disposed so as to successively receives bags from the continuously moving bag holding assemblies 3 and continuously transfers the bags to the rotor 7 of an apparatus used in next process.

As shown in the schematic diagram in FIG. 14, the bag holding assembly conveying device 4 is equipped with a rotational conveying mechanism 8 and a reciprocating driving mechanism 9. The rotational conveying mechanism 8 rotationally conveys a plurality of bag holding assemblies 3 (only the bags are shown in FIG. 14) disposed at equal intervals on an endless conveyor belt 2 in one direction along the annular track by means of a variable-speed driving motor $M_1$ The reciprocating driving mechanism 9 causes the rotational conveying mechanism 8 as a whole to perform a reciprocating motion over a specified distance along the parallel sections by means of a driving motor $M_2$ that has a variable feeding speed.

The rotational conveying speed of the bag holding assemblies determined by the driving motor $M_1$ and the speed of the reciprocating motion of the rotational conveying mechanism 8 determined by the driving motor $M_2$ are set at different values during the advancing motion (the motion of the bag holding assemblies in the conveying direction on the bag exit side B is taken as the advancing motion; in FIG. 14, this is the motion from the solid line to the two-dotted (imaginary) line) and the return motion (from the two-dotted (imaginary) line to the solid line). In this case, rotational conveying speed ($U_1$) of the bag holding assemblies determined by the driving motor $M_1$ and the speed of the advancing motion ($U_3$) of the rotational conveying mechanism 8 determined by the driving motor $M_2$ are synthesized (canceled out) during the advancing motion on the bag entry side A, so that the movement speed of the bag holding assemblies becomes zero. Furthermore, on the bag exit side B, the rotational conveying speed ($U_1$ during the advancing motion, $U_2$ during the return motion) of the bag holding assemblies determined by the driving motor $M_1$ during the reciprocating motion and the speed of the reciprocating motion ($U_3$ during the advancing motion, $U_4$ during the return motion) of the rotational conveying mechanism 8 determined by the driving motor $M_2$ are synthesized, and the speeds are set so that the movement speed of the bag holding assemblies is always constant.

With the settings as described above, on the bag entry side A, the bag holding assembly conveying device 4 receives bags W in bag holding assemblies 3 that have a movement speed of zero (i.e., that are in a stationary state) from the intermittent bag-supplying device 5 during the advancing motion of the rotational conveying mechanism 8. Also, on the bag exit side B, the bag holding assembly conveying device 4 continuously transfers bags W to the rotary type transfer device 6 at a constant speed.

In the above continuous bag-supplying apparatus 1, the driving conditions of the respective driving motors, etc., can be determined if the following conditions are set: i.e., the processing capacity (bags/minute), the number of bags (n) supplied at one time, the attachment pitch p (in meters) of the bag holding assemblies, and the time of the advancing motion of the rotational conveying mechanism 8 (=the intermittent stopping time of the bag holding assemblies on the bag entry side A) $t_1$ (in seconds).

The equations shown below are examples of calculations that are performed when it is assumed that the change-over from the speed during the advancing motion to the speed during the return motion (or the change-over from the speed during the return motion to the speed during the advancing motion) is performed instantaneously in the respective driving motors as shown in FIG. 15.

$$t_2=60\times n/S-t_1$$

$$M=(t_1\times S\times P/2)/60$$

$$U_1=S\times p/2$$

$$U_2=S\times p+(t_1\times S\times p/2)/(60\times n/S-t_1)$$

$$U_3=S\times p/2$$

$$U_4=(t_1\times S\times p/2)/(60\times n/S-t_1)$$

$$V_1=V_2=p\times S$$

$$V_3=0$$

$$V_4=60\times n\times p/(60\times n/S-t_1)$$

The respective symbols used in the above equations have the following meanings:

- $t_2$: time of the return motion of the rotational conveying mechanism (=intermittent movement time of the container holding assemblies on the bag entry side A)
- M (m): distance of the return motion of the rotational conveying mechanism (=return motion distance)
- $U_1$ (m/minute): rotational conveying speed of the bag holding assemblies (during the advancing motion of the rotational conveying mechanism)

$U_2$ (m/minute): rotational conveying speed of the bag holding assemblies (during the return motion of the rotational conveying mechanism)

$U_3$ (m/minute): speed of the advancing motion of the rotational conveying mechanism $U_4$ (m/minute): speed of the return motion of the rotational conveying mechanism $V_1$ (m/minute): synthesized movement speed of the bag holding assemblies on the bag exit side B (during the advancing motion of the rotational conveying mechanism)

$V_2$ (m/minute): synthesized movement speed of the bag holding assemblies on the bag exit side B (during the return motion of the rotational conveying mechanism)

$V_3$ (m/minute): synthesized movement speed of the bag holding assemblies on the bag entry side A (during the advancing motion of the rotational conveying mechanism)

$V_4$ (m/minute): synthesized movement speed of the bag holding assemblies on the bag entry side A (during the return motion of the rotational conveying mechanism)

Furthermore, if the distance over which the bag holding assemblies are conveyed during the return motion on the bag entry side A (i.e., the distance obtained by the synthesis of the conveying distance of the conveyance performed by the rotational conveying mechanism and the distance of the return motion of the rotational conveying mechanism) is designated as L, then, since L may be referred to as the distance advanced by the bag holding assemblies at a synthesized speed of $V_4$ during the return motion time of $(t_2/60)$ minutes, L may be expressed as follows:

$$L=V_4 \times t_2/60$$

If the above-described $V_4$ and $t_2$ are substituted into this equation, the following equation is obtained:

$$L=p \times n$$

In other words, on the bag entry side A of the rotational conveying mechanism 8, n bag holding assemblies are conveyed at one time during the return motion time, and n bags W are supplied at one time during the advancing motion time. Accordingly, bags W can be intermittently and successively supplied to all the bag holding assemblies, so that the conveyance of bag holding assemblies in an empty state (i.e., a state with no bag) can be prevented.

Furthermore, in the above-described calculation example, the switching of the speeds of the respective driving motors was assumed to be instantaneous. In an actual apparatus, however, the switching of the speeds of the driving motors cannot be accomplished instantaneously, and acceleration and deceleration are necessary only at the time of switching. Accordingly, calculations must be performed with this point taken into account.

To describe the structure of the continuous bag-supplying apparatus 1 in somewhat greater detail, the bag holding assembly conveying device 4 which is a part of the continuous bag-supplying apparatus 1 comprises, as shown in FIGS. 11 through 13, a reciprocating driving mechanism 9 and a rotational conveying mechanism 8. The reciprocating driving mechanism 9 is disposed on the surface of a bed 11, and the rotational conveying mechanism 8 is disposed on top of the reciprocating driving mechanism 9 and rotationally conveys a plurality of bag holding assemblies 3 along an annular track that has a pair of parallel sections.

The reciprocating driving mechanism 9 comprises: sliding members 14 through 16 which are disposed on the undersurfaces of supporting stands 12 and 13; rails 17 through 19 which are fastened to surface of the bed 11 and over which the sliding members 14 through 16 slide; bearings 21 and 22 which are fastened to the surface of the bed 11; a screw rod 23 which is rotatably supported by the bearings 21 and 22; a variable-speed driving motor (servo motor) $M_2$ which rotationally drives the screw rod 23; and a nut member 24 which is fastened to the undersurface of a frame 12 and is screw-engaged with the screw rod 23. The rotational conveying mechanism 8 is caused to perform a reciprocating motion to the left and right by driving the driving motor $M_2$ in the forward and reverse directions.

The rotational conveying mechanism 8 is equipped with: left and right supporting shafts 26 and 27 which are rotatably supported on a frame 25; a pair of pulleys 28 and 29 which are fastened to the supporting shafts 26 and 27 and are driven by a driving motor (servo motor) $M_1$ with a variable rotational speed so that the pulleys 28 and 29 rotate in the horizontal plane; and a conveyor belt (timing belt) 31 which is installed between the pulleys 28 and 29. Bag holding assemblies 3 that each comprises a pair of holding members (left and right holding members) 3*a* and 3*b* are attached to the outer circumferential surface of the conveyor belt 31 at equal intervals (pitch=p). Bags W are inserted and held in the longitudinal spaces or grooves demarcated by the holding members 3*a* and 3*b* and the conveyor belt 31.

In addition, opening-and-closing bag guides 32 and 33 which guide the movement of the bags W that are supplied to the bag holding assemblies 3 are disposed along the track of the bag holding assemblies 3 in positions above and below the bag holding assemblies 3 on the bag entry side A.

The opening-and-closing bag guides 32 and 33 are caused to open and close simultaneously (as indicated by the solid and two-dotted (imaginary) lines in FIG. 13) by the operation of air cylinder 34 via opening-and-closing mechanisms 35 and 36. When the opening-and-closing bag guides 32 and 33 are closed, the upper-side opening-and-closing bag guide 32 is positioned in front of the bags W, and the lower-side opening-and-closing bag guide 33 is positioned in front of the bags W and at the same time supports the lower ends of the bags W.

The timing of the opening and closing of the opening-and-closing bag guides 32 and 33 is set so that the opening-and-closing bag guides 32 and 33 are opened immediately prior to the stopping of the bag holding assemblies 3 so as to supply bags W to the bag holding assemblies 3; then, the opening-and-closing bag guides 32 and 33 are closed immediately after the bags W have been supplied, so that the bags W supplied to the longitudinal spaces or grooves of the bag holding assemblies 3 are prevented from dropping through or flying out in the forward direction and so that the movement of the bags W is guided.

The lengths of the opening-and-closing bag guides 32 and 33 are set so that the lengths are more or less equal to the width occupied by the plurality of bag holding assemblies 3 to which bags W are supplied.

Fixed bag guides 37 and 38 are disposed above and below in the area extending from the ends of the opening-and-closing bag guides 32 and 33, around the pulley 28 and as far as the vicinity of the rotary type transfer device 6. The fixed bag guides similarly prevent the bags W from falling through or flying out.

As seen from FIG. 13, in the intermittent bag-supplying device 5, which is a part of the continuous bag-supplying apparatus 1, n conveyor magazine type bag-supplying devices similar to that described in, for instance, Japanese Patent Application Laid-Open (Kokai) No. H8-337217 are lined up side by side.

More specifically, each of the bag-supplying devices is equipped with: a belt conveyor 39 which continuously conveys a plurality of bags that are placed in a state in which the bags are partially overlapped with the mouths of the bags facing forward and downward; guide plates 41 which are disposed on the left and right and guide both side edges of the bags; a fast-feeding belt 42 which rotates at a higher speed than the belt conveyor 39, separates the leading bag conveyed by the belt conveyor 39 from the following bags, and fast-feeds the leading bag forward; a vacuum-chucking extraction arm 44 which vacuum-chucks (by means of a suction plate attached to the tip end of the arm) the bags W that have stopped as a result of contacting a stopper 43 located in front and lifts the bags W a specified distance; and a vacuum-chucking swinging arm 45 which vacuum-chucks the bags W by means of a suction plate attached to the tip end of the arm 45 and pivots upward so that the bags W are brought precisely into the longitudinal spaces or grooves of the bag holding assemblies 3.

Furthermore, a rotary type transfer device 6 which has a plurality of transfer means 47 installed on the outer circumference of a rotor 46 at equal intervals that are the same as the attachment spacing (pitch=p) of the bag holding assemblies 3 is disposed beyond the point where the fixed bag guides 37 and 38 end on the bag exit side B. The rotor 46 is caused to rotate continuously by a driving motor (servo motor) not shown, and vacuum passages 48 formed in the rotor 46 open in the side surfaces of the transfer means 47. From the position where the vacuum passages 48 each face the front surface of the corresponding bag holding assembly 3 to a position where the vacuum passages 48 have rotated approximately 180° C. from the above-described position facing the bag holding assembly 3, the vacuum passages 48 are connected to a vacuum pump (not shown).

On the bag exit side B, the transfer means 47 rotate in the horizontal plane at the same speed and timing as the continuously rotating bag holding assemblies 3. The transfer means 47 continuously chuck and receive bags W from the bag holding assemblies 3, and then transfer the bags W to the rotor 7 of the next process after completing half of a revolution.

Furthermore, extraction guides 49 are installed above and below beyond the fixed bag guides 37 and 38. The extraction guides 49 contact the rear sides of the bags W and guide the bags W along the rotational track of the transfer means 47 and assist the chucking.

Generally, packaging bag shapes have various width dimensions and length dimensions according to the type of product that is packaged. Accordingly, in continuous filling and packaging systems, it is desirable that the system have a structure that can handle various types of bags that have different dimensions. However, the continuous bag-supplying apparatus (and especially the container holding assembly conveying device) can only supply bags that have roughly the same dimensions in terms of both width and length.

SUMMARY OF THE INVENTION

Accordingly, the object of the present invention is to provide a continuous container-supplying apparatus that is capable of handling containers of various dimensions and shapes.

The above object is accomplished by a unique structure for a continuous container-supplying apparatus that comprises a container holding assembly conveying device and a container-supplying device, in which the container holding assembly conveying device comprises a plurality of container holding assemblies that are disposed at equal intervals so as to be moved in one direction along an annular track which has a pair of parallel sections, the container holding assemblies being moved, on a first side of the parallel sections, intermittently in an action in which a distance of the intermittent movement is an integral multiple of an attachment spacing of the container holding assemblies, and the container holding assemblies being moved, on a second side of the parallel sections, continuously at a constant speed;

the container-supplying device simultaneously supplies a plurality of containers respectively to each of the plurality of container holding assemblies on the first side of the parallel sections; and the continuous container-supplying apparatus supplies, by way of the container-supplying device, the containers in a plurality of rows to the container holding assemblies that are stopped on the first side of the parallel sections, the continuous container-supplying apparatus successively removing the containers from continuously moving container holding assemblies on the second side of the parallel sections; and in which each of the container holding assemblies is: comprised of a right-side holding member and a left-side holding member that hold each of the containers between the right-side holding member and left-side holding member; provided at equal intervals on conveying bodies that run along the annular track; and adjustable in regards to the spacing between the right-side and left-side holding members thereof.

With the above structure, containers (e.g., packaging bags) that have various width dimensions can be handled.

In the above, the "conveying bodies" refers to a long body such as a belt, chain and the like that runs along the annular track.

More specifically, the conveying bodies are installed in a vertical relationship; the left-side holding member and right-side holding member are respectively provided on either one of the conveying bodies; and a spacing adjustment means is provided so as to adjust a relative positional relationship, in regards to the running direction of the conveying bodies, between one of the conveying bodies on which the left-side holding member is provided and another one of the conveying bodies on which the right-side holding member is provided. More specifically, each of the container holding assemblies is comprised of a pair of the right-side and left-side holding members; two conveying bodies are disposed one on the other; and the left-side and right-side holding members are respectively provided on either one of the two conveying bodies. As a result, the left-side and right-side holding members of the container holding assemblies can be simultaneously adjusted in terms of the space in between at one time.

In the above-described continuous container-supplying apparatus, when the container holding assemblies are provided on the outside surfaces of the conveying bodies and hold container, it is desirable that the right-side and left-side holding members have vertical guide portions that hold left and right edges of the containers and back surface portions that are formed so as to face inward along the conveying bodies and extend from the guide portions. The spacing between the left and right guide portions is set so as to be roughly the same as or slightly greater than the width of the containers, and the spacing of the back surface portions is set so as to be slightly smaller than the width of the containers. The containers are thus held in the space that are defined by the guide portions and back surface portions and are open outwardly.

The above-described object is further accomplished by another unique structure for a continuous container-supplying apparatus that comprises a container holding assembly conveying device and a container-supplying device, in which the container holding assembly conveying device comprises a plurality of container holding assemblies that are disposed at equal intervals so as to be moved in one direction along an annular track which has a pair of parallel sections, the container holding assemblies being moved, on a first side of the parallel sections, intermittently in an action in which a distance of the intermittent movement is an integral multiple of an attachment spacing of the container holding assemblies, and the container holding assemblies being moved, on a second side of the parallel sections, continuously at a constant speed;

the container-supplying device simultaneously supplies a plurality of containers respectively to each of the plurality of container holding assemblies on the first side of the parallel sections; and the continuous container-supplying apparatus supplies, by way of the container-supplying device, the containers in a plurality of rows to the container holding assemblies that are stopped on the first side of the parallel sections, the continuous container-supplying apparatus successively removing the containers from continuously moving container holding assemblies on the second side of the parallel sections; and in which each of the container holding assemblies is comprised of a right-side holding member and a left-side holding member that hold each of the containers between the right-side holding member and left-side holding member; and a receiving stand that supports a bottom portion of each of the containers is further provided along the annular track and beneath the container holding assemblies, the receiving stand being adjustable in regards to a height thereof With this structure, containers (e.g., packaging bags) of various length dimensions can be handled. The height adjustable receiving stand can be operated together with the right-side and left-side holding members that form the container holding assembly and are adjustable in regards to the spacing thereof.

Furthermore, the above-described container holding assembly conveying device is equipped with, for instance, a rotational conveying mechanism and a reciprocating driving mechanism. The rotational conveying mechanism rotationally conveys the plurality of container holding assemblies, that are disposed at equal intervals, in one direction along the annular track that has the pair or parallel sections, and the reciprocating driving mechanism causes the rotational conveying mechanism as a whole to perform a reciprocating motion over a specified distance along the parallel sections. These rotational conveying mechanism and the reciprocating driving mechanism are equipped with respectively independent driving sources. In this case, the container holding assemblies run at a movement speed produced by a synthesis of the rotational conveying and reciprocating motion.

Furthermore, a rotary type transfer device, which has a plurality of transfer means disposed at equal intervals, may be installed on the second side of the parallel sections as a part of the continuous container-supplying apparatus. The rotary type transfer device continuously receives containers from the container holding assemblies by continuously rotating transfer means and then continuously supplies the containers to the rotor of the device of the next process. In other words, the container holding assembly conveying device continuously supplies containers via the rotary type transfer device. Needless to say, the installation spacing and movement speed of the rotary type transfer means are set so as to agree with those of the container holding assemblies.

DETAILED DESCRIPTION OF THE INVENTION

The continuous container (bag)-supplying apparatus of the present invention differs from the conventional apparatus in that the continuous container-supplying apparatus of the present invention is able to process containers or packing bags (called simply, "bag(s)") of different sizes (in width and length). In other respects, the continuous container-supplying apparatus of the present invention is substantially the same as the conventional apparatus. In the following, mainly the points that distinguish the present invention from the prior art will be described.

Figure 3A:
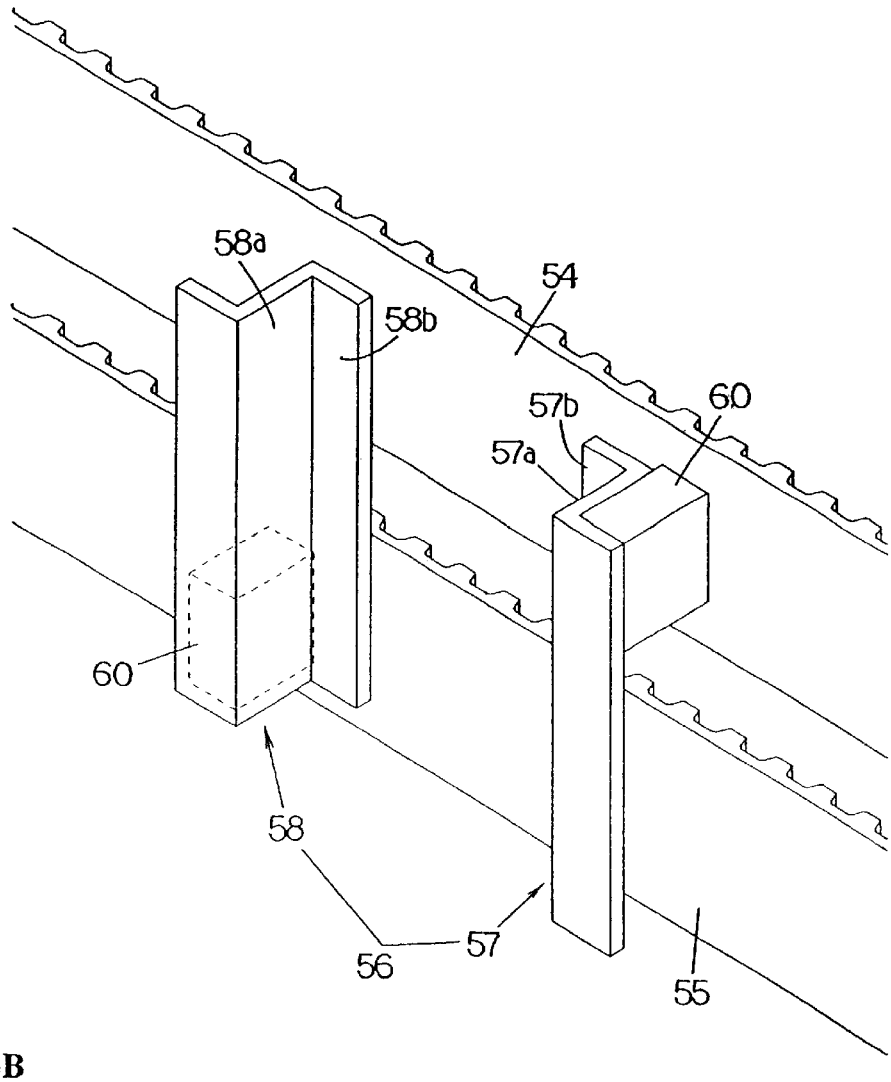
FIG. 3A is a perspective view of the container holding assemblies and conveyor belts.
Figure 3B:
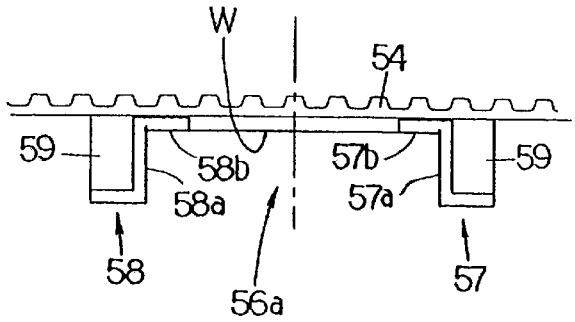
FIG. 3B is a top view thereof.
Figure 5B:
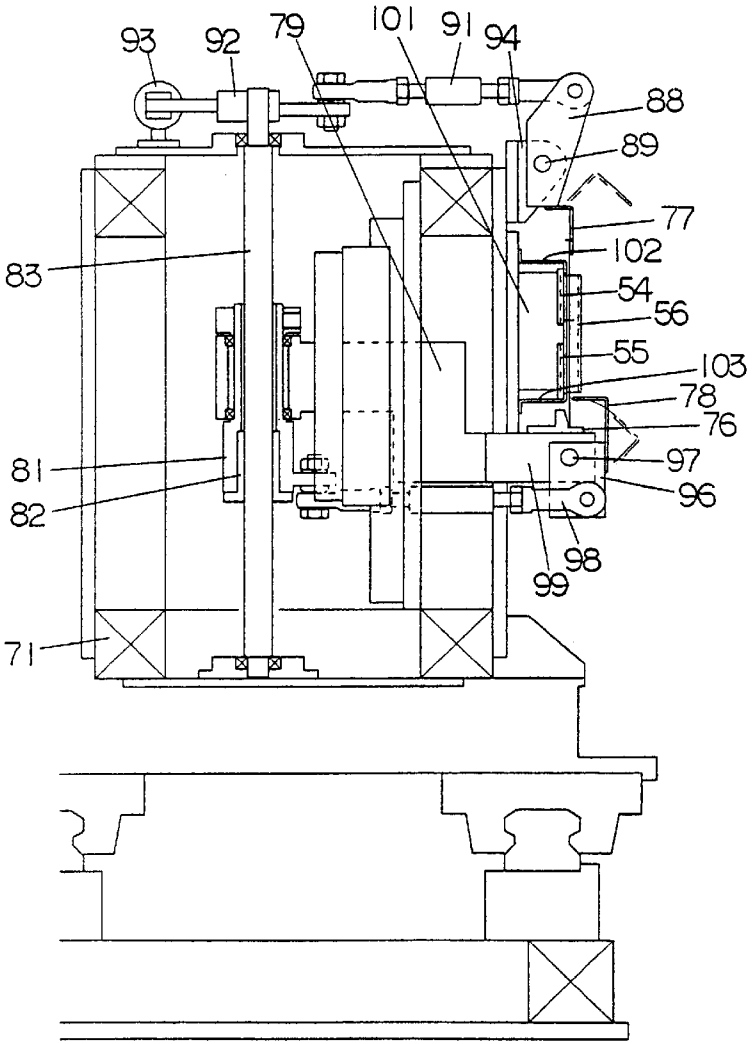
FIGS. 5A and 5B are sectional views of the height adjustment means of the bag (container) bottom receiving stand on the container (packing bag) entry side of the container (packing bag) holding assembly conveying device.
Figure 5A:
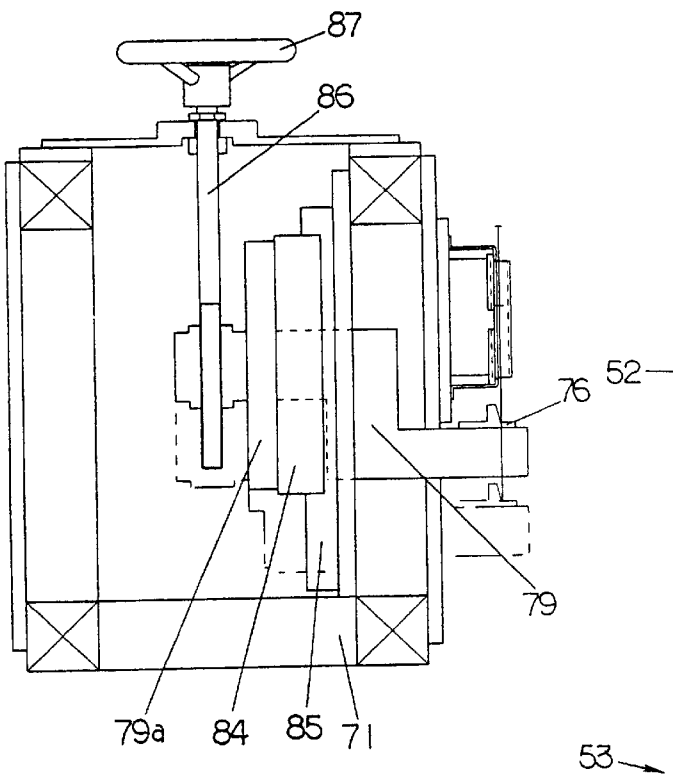

As in the conventional apparatus, the container (or bag) holding assembly conveying device 51 of the continuous container-supplying apparatus of the present invention comprises a rotational conveying mechanism 52 and a reciprocating driving mechanism 53 (see FIGS. 5A and 5B). As best shown in FIGS. 3A and 3B, in the rotational conveying mechanism 52, the conveyor belt comprises an upper conveyor belt (or upper conveying body) 54 and a lower conveyor belt (or lower conveying body) 55; and of the right-side and left-side holding members that constitute pairs container (bag) holding assemblies 56, the right-side holding members 57 are provided on the upper conveyor belt 54, and the left-side holding members 58 are provided on the lower conveyor belt 55, via respective attachment elements 60. In other words, each container holding assembly 56 is comprised of the right-side holding member 57 and the left-side holding member 58, and such right-side holding member 57 and left-side holding member 58 are respectively provided on the upper conveyor belt 54 and on the lower conveyor belt 55 via respective attachment elements 60. The relative positional relationship of the upper and lower conveyor belts 54 and 55 can be altered in the conveying direction; as a result, the spacing between the right-side and left-side holding members 57 and 58 is adjusted.

More specifically, the right-side and left-side holding members 57 and 58 have guide portions 57*a* and 58*a* that are oriented perpendicular to the respective conveyor belts 54 and 55, and back surface portions 57*b* and 58*b* which are formed so as to face inward along the conveyor belts 54 and 55 from the inside ends of the guide portions 57*a* and 58*a*. Bags (or containers) W are held in the vertical longitudinal spaces or grooves 56*a* that are formed by the guide portions 57*a* and 58*a* and back surface portions 57*b* and 58*b* of the right-side and left-side holding members 57 and 58. The distance between the inside walls of the guide portions 57*a* and 58*a* is set so that this distance is roughly the same or slightly greater than the width of the bags (containers), and the spacing of the inside ends of the back surface portions 57*b* and 58*b* is set so that this spacing is slightly smaller than the width of the bags. Furthermore, if the back surface portions 57*b* and 58*b* were absent, there might be instances in which the bags would enter the spaces behind the guide portions 57*a* and 58*a* (i.e., the gaps between the guide portions 57*a* and the lower conveyor belt 55 or the gaps between the guide portions 58*a* and the upper conveyor belt 54).

Figure 4A:
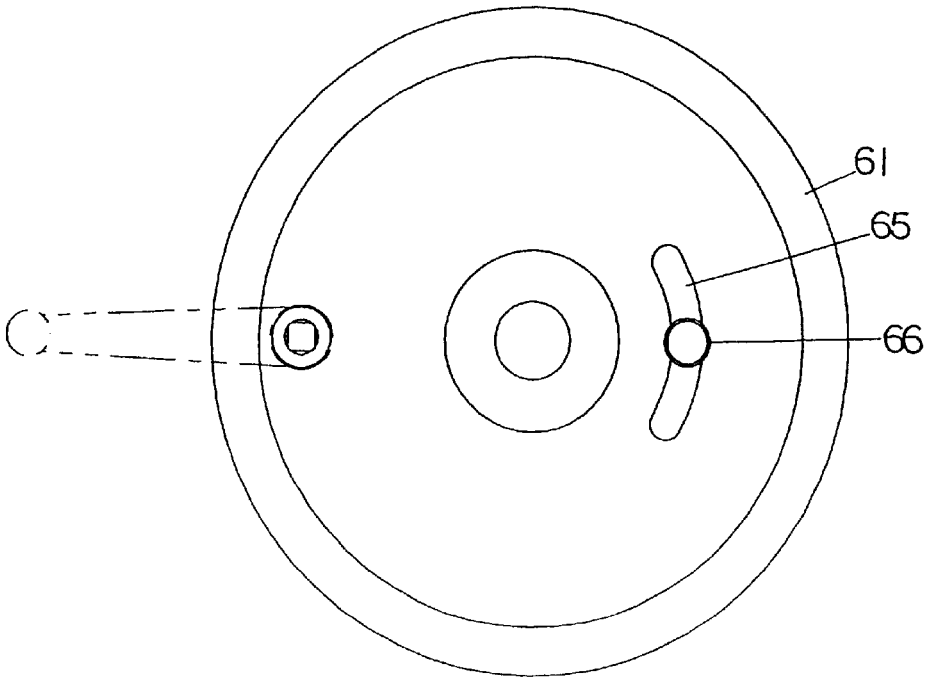
FIG. 4A is a top view of the essential portion of the spacing adjustment means used to adjust the spacing of the container holding assemblies.
Figure 4B:
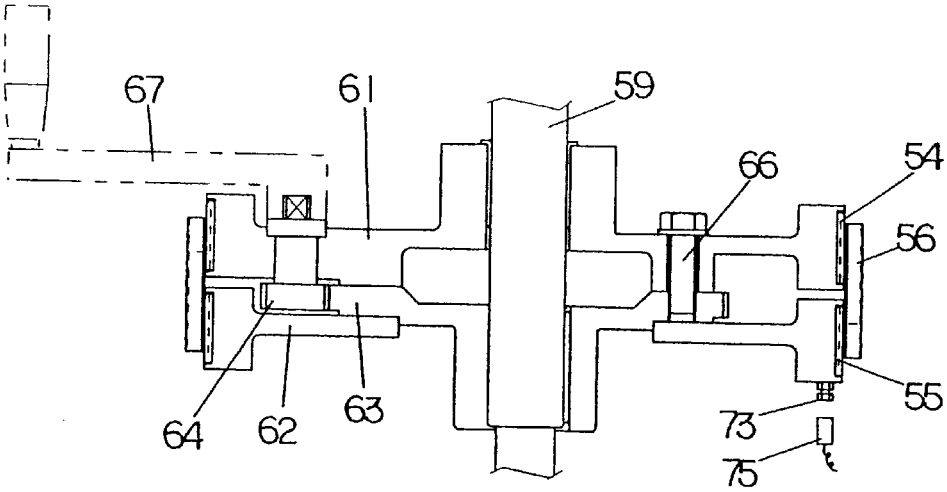
FIG. 4B is a sectional view thereof.

FIGS. 4A and 4B show the spacing adjustment means used to adjust the spacing between the right-side and left-side holding members 57 and 58.

Here, upper and lower pulleys 61 and 62 corresponding to the upper and lower conveyor belts 54 and 55 are attached to a supporting shaft 59. The lower pulley 62 is fastened to the supporting shaft 59 via a flat gear 63, and a gear 64 attached to the upper pulley 61 engages with the flat gear 63. Furthermore, the upper pulley 61 is installed so that it is free to rotate with respect to the supporting shaft 59, and the upper pulley 61 has a slot 65 that is formed in the shape of a circular arc. A bolt 66 can be passed through the slot 65 so that the upper pulley 61 can be fastened to the flat gear 63 (lower pulley 62). When the spacing between the holding members 57 and 58 is to be adjusted, the bolt 66 is loosened, and the gear 64 is rotated by means of a spacing adjustment lever 67, so that the upper pulley 61 is rotated by a specified amount relative to the lower pulley 62. As a result, the upper conveyor belt 54 moves along the conveying direction (together with the right-side holding members 57), so that the spacing between the right-side and left-side holding members 57 and 58 is altered. Following the alteration of the spacing, the bolt 66 is re-tightened. Furthermore, upper and lower pulleys 104 and 105 (see FIGS. 6A and 6B) corresponding to the upper and lower conveyor belts 54 and 55 are also attached to another supporting shaft. The upper pulley 104 is rotatable with respect to the supporting shaft, the lower pulley 105 is fastened to the supporting shaft, and the upper and lower pulleys 104 and 105 are fastened to each other by means of a bolt in the same manner as the upper and lower pulleys 61 and 62.

In the container or bag holding assembly conveying device 51, since the spacing adjustment means has a structure in which the upper conveyor belt 54 moves (along with the right-side holding members 57) with the lower conveyor belt 55 (and the left-side holding members 58) as a reference, the centers of the right-side and left-side holding members 57 and 58 (i.e., the centers of the bags W) are shifted when the above-described spacing adjustment is performed. Meanwhile, the intermittent container-or bag-supplying device 68 (see FIG. 8) installed on the bag (container) entry side A of the bag holding assembly conveying device 51, and the rotary type transfer device 69 installed on the bag exit side, are installed with the centers of the bags as a reference.

Accordingly, in order to ensure the satisfactory supply of bags from the intermittent container-or bag-supplying device 68 and the satisfactory transfer of the bags to the rotary type transfer device 69 when the apparatus is re-started following the above-described spacing adjustment, it is necessary to return the shifts of the centers of the right-side and left-side holding members 57 and 58 to the original positions in the bag holding assembly conveying device 51.

Accordingly, in the bag holding assembly conveying device 51, a first detection element 72 (see FIG. 1) is attached to the frame 71 of the rotational conveying mechanism 52, and a second detection element 73 (see FIGS. 4A and 4B) is attached to the lower pulley 62. Respective sensors 74 (used to detect the origin position of the reciprocating motion) and 75 (used to detect the origin position of the rotation) which detect the detection elements are provided, and the system is set so that when the width dimension of the bags following alteration is input into the control section following adjustment of the spacing, the control section causes the driving motors $M_1$ and $M_2$ to rotate by specified amounts on the basis of this input signal and the signals from the sensors, thus automatically corrected the shifts of the centers of the right-side and left-side holding members 57 and 58.

Furthermore, if a mechanism which is such that the left-side holding members (lower conveyor belt) and right-side holding members (upper conveyor belt) move together and apart by equal distances with reference to the centers of the right-side and left-side holding members is used as the spacing adjustment means, such automatic correction control is unnecessary.

Figure 1:
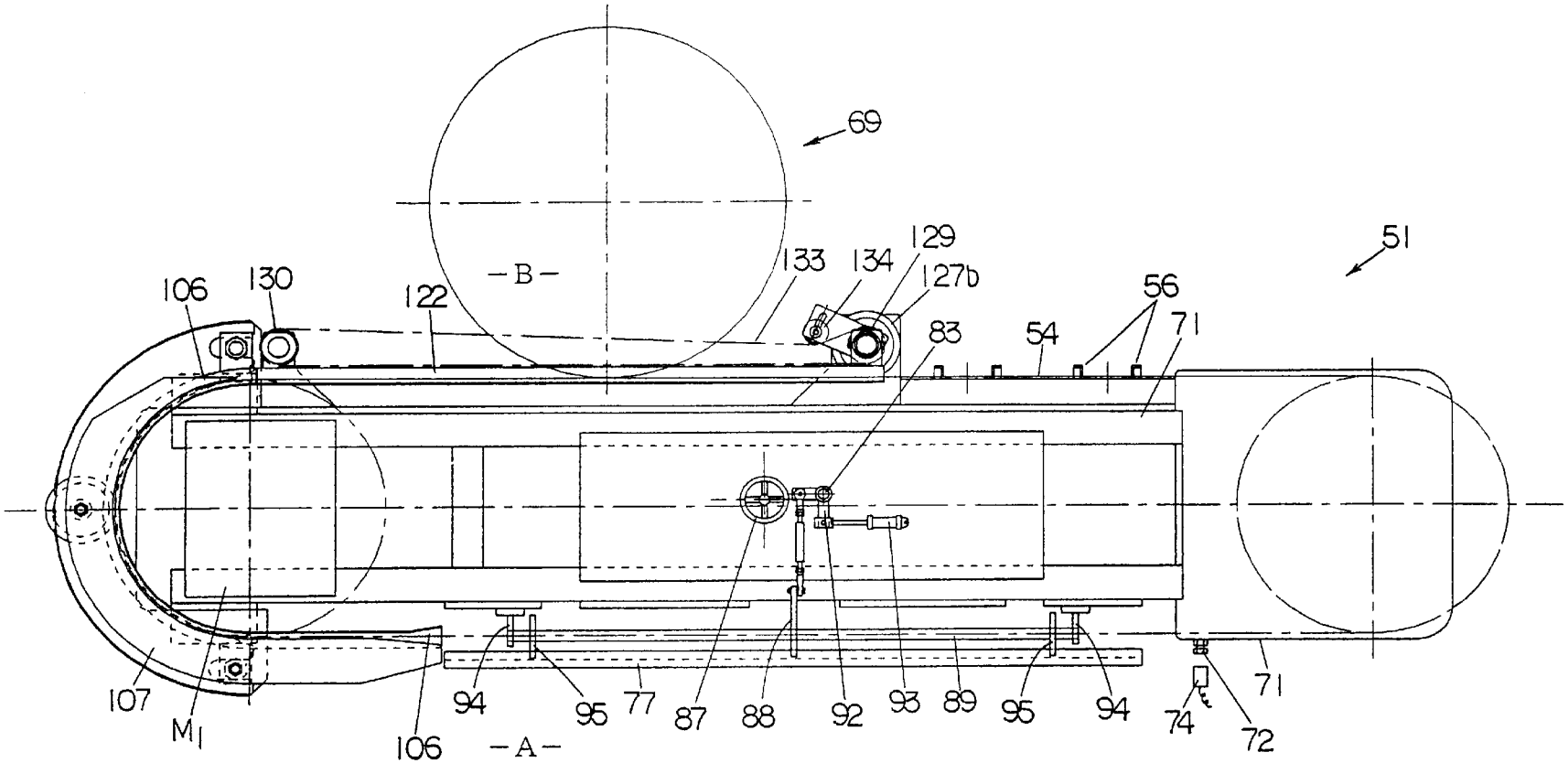
FIG. 1 is a top view of the container holding assembly conveying device of the continuous container-supplying apparatus of the present invention.
Figure 2:
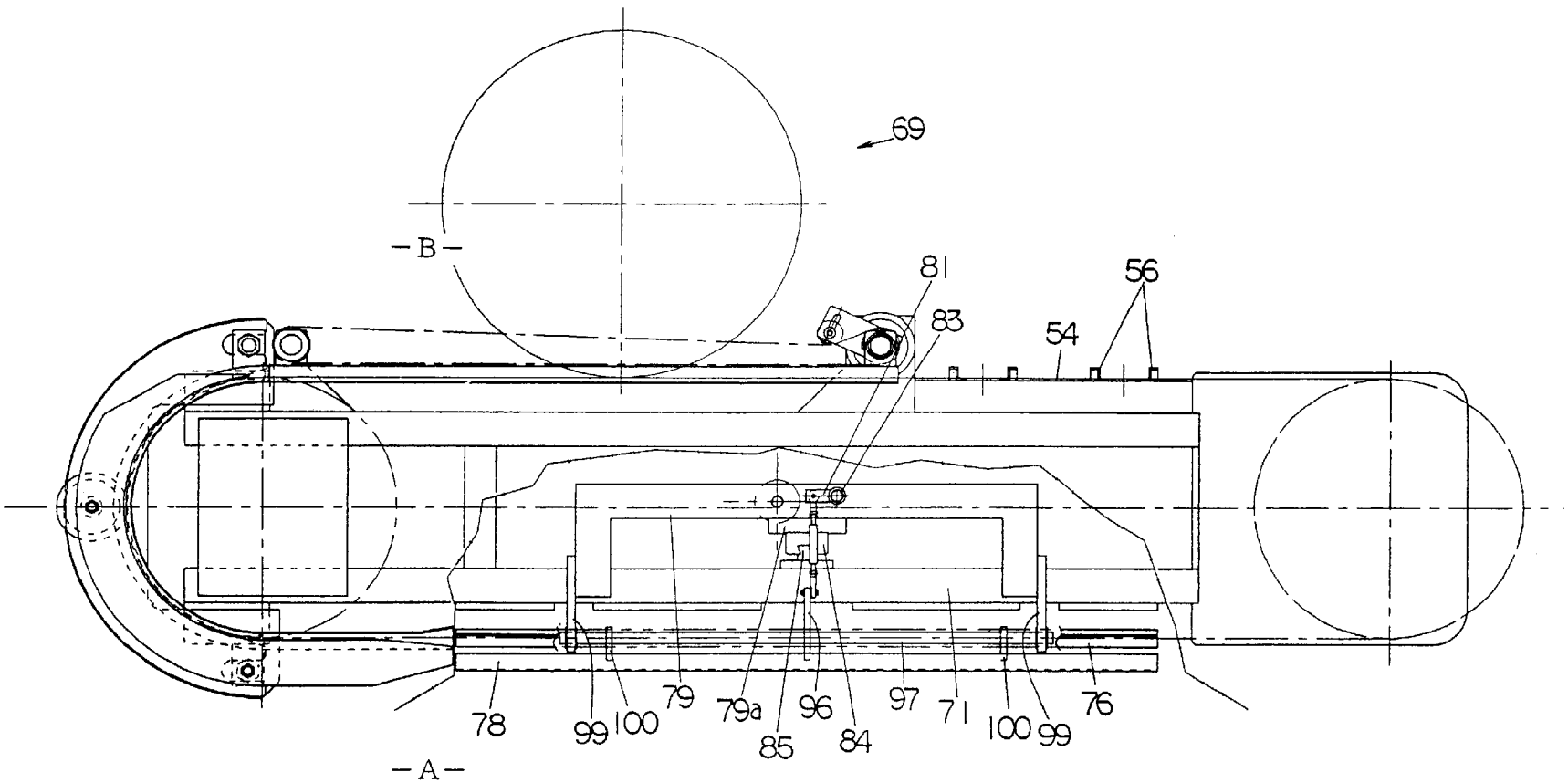
FIG. 2 is a partially cut-away top view of the same.

As shown in FIGS. 5A and 5B and also FIGS. 1 and 2, a bag or container bottom receiving stand 76 which supports the bottom portions of the bags W supplied to the bag or container holding assemblies 56 is installed in a position beneath the bag holding assemblies 56 on the bag entry side A in the rotational conveying mechanism 52. Furthermore, in positions above and below the bag holding assemblies 56, opening-and-closing bag guides 77 and 78 which guide the movement of the bags W are both installed over a length that is approximately equal to the width occupied by the plurality of container holding assemblies 56 to which bags W are supplied along the track of the bag holding assemblies 56.

The upper and lower opening-and-closing bag guides 77 and 78 open and close simultaneously (as indicated by the solid lines and two-dotted (imaginary) lines in FIGS. 5 and 5B). When the guides are closed, the guides are both positioned in front of the bags W. The timing of the opening and closing of the guides 77 and 78 is set so that the guides are opened immediately prior to the stopping of the bag holding assemblies 56, thus allowing the supply of bags W to the bag holding assemblies 56, and so that the guides are closed immediately after the bags W have been supplied, thus preventing the bags W that have been supplied to the longitudinal spaces or grooves 56*a* of the bag holding assemblies 56 and supported on the bag bottom receiving stand 76 from flying out in the forward direction, and also guiding the movement of the bags W.

As shown in FIGS. 5A and 5B, the bag bottom receiving stand 76 is attached to a raising-and-lowering holder 79, and the raising-and-lowering holder 79 is supported on a swinging lever 81 so that the raising-and-lowering holder 79 is free to rotate in relative terms. The swinging lever 81 is attached to an opening-and-closing driving shaft 83 which is fastened to the inside via a slide bearing 82. The opening-and-closing driving shaft 83 is supported on the frame 71 of the rotational conveying mechanism 52 so that the opening-and-closing driving shaft 83 is free to rotate, and longitudinal ribs are formed on the outer circumferential surface of the opening-and-closing driving shaft 83. Meanwhile, longitudinal spaces or grooves that accommodate the longitudinal ribs of the opening-and-closing driving shaft 83 are formed in the inner circumferential surface of the slide bearing 82. Accordingly, when the opening-and-closing driving shaft 83 rotates, the swinging lever 81 also rotates. However, this rotational force is not transmitted to the raising-and-lowering holder 79, and the swinging lever 81 and raising-and-lowering holder 79 are allowed to rise and fall along the opening-and-closing driving shaft 83.

The raising-and-lowering means of the bag bottom receiving stand 76 is shown in particular detail in FIG. 5B.

A slider 84 is fastened to a slider attachment part 79*a* on the raising-and-lowering holder 79, and the slider 84 is free to slide along a raising-and-lowering rail 85 which is attached to the frame 71 in a vertical position. Furthermore, an adjustment shaft 86 is screw-engaged with the rear end of the raising-and-lowering holder 79, and the adjustment shaft 86 can be freely rotated by means of an adjustment handle 87. The raising-and-lowering holder 79 can be raised and lowered by rotating the adjustment handle 87 (the swinging lever 81 is raised and lowered at the same time), thus making it possible to adjust the height of the bag bottom receiving stand 76. As a result of the height of the bag bottom receiving stand 76 being made adjustable, bags of different length dimensions can be supplied; furthermore, bags can always be supplied using the upper ends of the bags as a reference regardless of the length dimension. Accordingly, this is convenient for packaging treatments in subsequent processes.

Furthermore, the opening-and-closing means of the upper and lower opening-and-closing bag guides 77 and 78 are shown in detail in FIG. 5A. The upper opening-and-closing bag guide 77 is attached to the tip end of an upper opening-and-closing lever 88, and opens and closes between the position indicated by the solid line and the position indicated by the two-dotted (imaginary) line in FIG. 5A. The upper opening-and-closing lever 88 is attached to a fulcrum shaft 89 that is parallel to the conveying direction, and the lever 88 is free to swing within a vertical plane. The upper opening-and-closing lever 88 is caused to swing by an air cylinder 93 via a connecting rod 91 which is attached to the rear end, and an opening-and-closing driving lever 92 which is fastened to the upper end of the opening-and-closing driving shaft 83. When the lever 88 swings, the upper opening-and-closing bag guide 77 opens and closes. In addition, both ends of the fulcrum shaft 89 are supported on bearings 94 attached to the fame 71 so that the fulcrum shaft 89 is free to rotate. Furthermore, the upper opening-and-closing bag guide 77 is further connected to the fulcrum shaft 89 by left and right connecting members 95.

Meanwhile, the lower opening-and-closing bag guide 78 is attached to a lower opening-and-closing lever 96, and opens and closes between the position indicated by the solid line and the position indicated by the two-dotted (imaginary) line in FIG. 5A. The lower opening-and-closing lever 96 is attached to the raising-and-lowering holder 79 so that the lower opening-and-closing lever 96 is pivotable, and the lower opening-and-closing lever 96 is free to swing within the vertical plane about a fulcrum shaft 97 that is parallel to the conveying direction. The lower opening-and-closing lever 96 is caused to swing by the air cylinder 93 via a connecting rod 98 attached to the lower end of the lower opening-and-closing lever 96, the swinging lever 81, the opening-and-closing driving shaft 83 and the opening-and-closing driving lever 92. As the lower opening-and-closing lever 96 swings, the lower opening-and-closing bag guide 78 opens and closes in synchronization with the upper opening-and-closing bag guide 77. In addition, both ends of the fulcrum shaft 97 are supported on bearings 99 attached to the raising-and-lowering holder 79 so that the fulcrum shaft 97 is free to rotate. Like the upper opening-and-closing bag guide 77, the lower opening-and-closing bag guide 78 is further connected to the fulcrum shaft 97 by left and right connecting members 100.

Furthermore, in FIGS. 5A and 5B, the reference numeral 101 is a receiving block that supports the conveyor belts from the inside, 102 is a guide for the upper conveyor belt 54, and 103 is a guide for the lower conveyor belt 55.

Figure 6A:
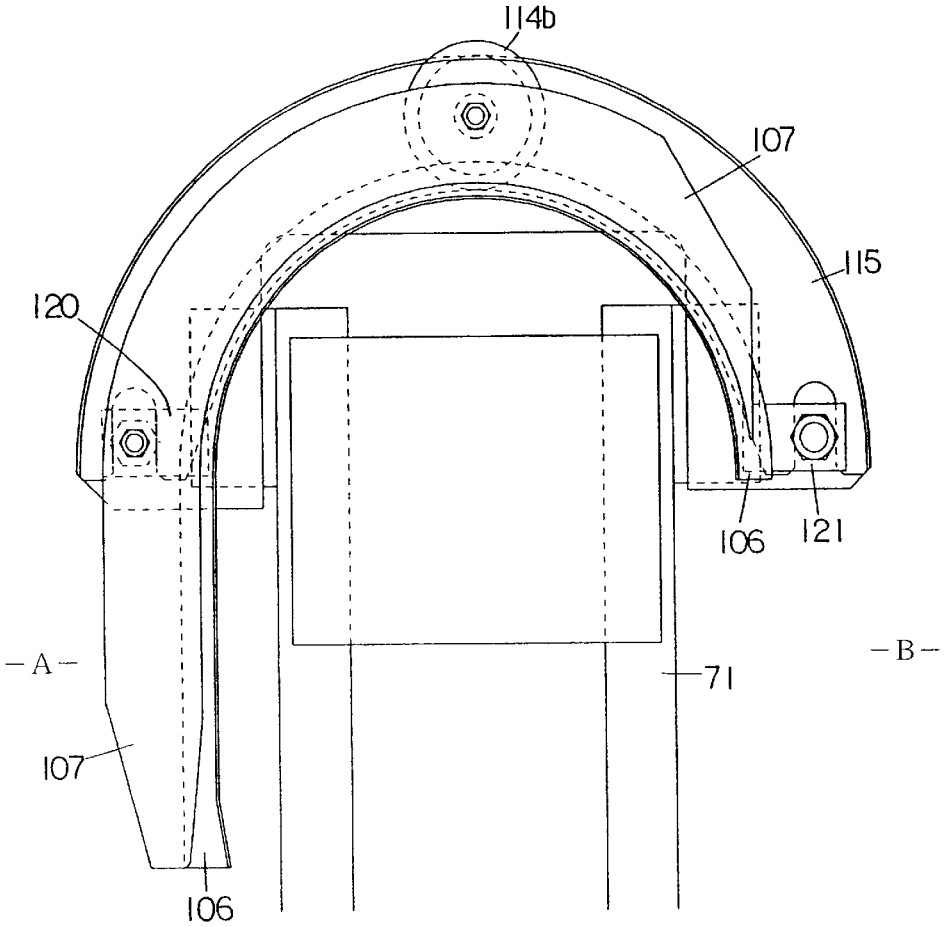
FIG. 6A is a top view of the height adjustment means of the bag (container) bottom receiving stand around the circumference of the pulleys of the same.
Figure 6B:
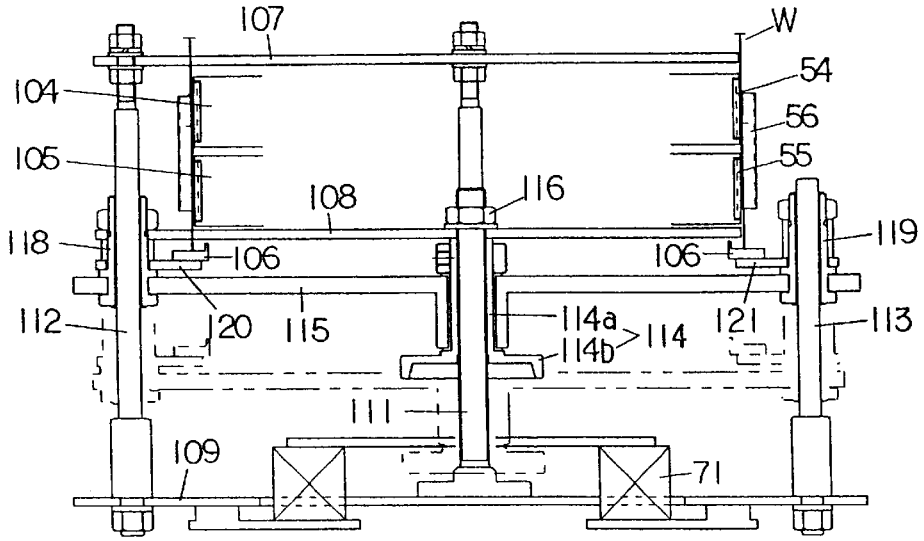
FIG. 6B is a sectional view thereof.

FIGS. 6A and 6B show the bag bottom receiving stand 106 and upper and lower conveying guides 107 and 108 installed around the pulleys 104 and 105 that direct the bag holding assemblies 56 from the bag entry side A toward the bag exit side B, and the height adjustment mechanism for the bag bottom receiving stand 106 and lower conveying guide 108.

The bag bottom receiving stand 106 and upper and lower conveying guides 107 and 108 are installed as continuations of the bag bottom receiving stand 76 and upper and lower opening-and-closing bag guides 77 and 78 on the bag entry side A. These components are formed so that they are bent along the semicircular track of the bag holding assemblies 56 around the circumferences of the pulleys 104 and 105 and guide the movement of the bags held in the longitudinal spaces or grooves 56*a* of the bag holding assemblies 56.

A supporting shaft 111, which has an external screw formed on its outer circumference, and guide shafts 112 and 113, are installed in upright positions of a plated 109 which is disposed on the frame 71. An adjustment member 114 which has a tubular part 114*a* with an internal screw formed inside and an adjustment handle 114*b* on its lower end is screw-engaged with the supporting shaft 111, and the central tubular part of a raising-and-lowering plate 115 is fit over the circumference of the tubular part 114*a* so that the raising-and-lowering plate 115 is free to rotate relative to the tubular part 114*a*. The lower conveying guide 108 which has a through-hole into which the supporting shaft 111 is loosely inserted is fastened to the upper end of the tubular part 114*a* by means of a lock nut 116, and the upper conveying guide 107 is further fastened to the upper end of the supporting shaft 111. Raising-and-lowering holders 118 and 119 which are fastened to the raising-and-lowering plate 115 are fitted over the guide shafts 112 and 113 so that the raising-and-lowering holders 118 and 119 are free to slide upward and downward, and the bag bottom receiving stand 106 is fastened to the raising-and-lowering holders 118 and 119 via attachment plates 120 and 121. The lower conveying guide 107 is fastened to the raising-and-lowering holder 118, and the upper conveying guide 107 is fastened to the upper end of the guide shaft 112.

When the lock nut 116 is loosened and the adjustment handle 114*b* is rotated, the raising-and-lowering plate 115 and raising-and-lowering holders 118 and 119 can be raised and lowered, thus causing the bag bottom receiving stand 106 and lower conveying guide 108 to be raised and lowered so that the heights of these parts can be adjusted.

Figure 7B:
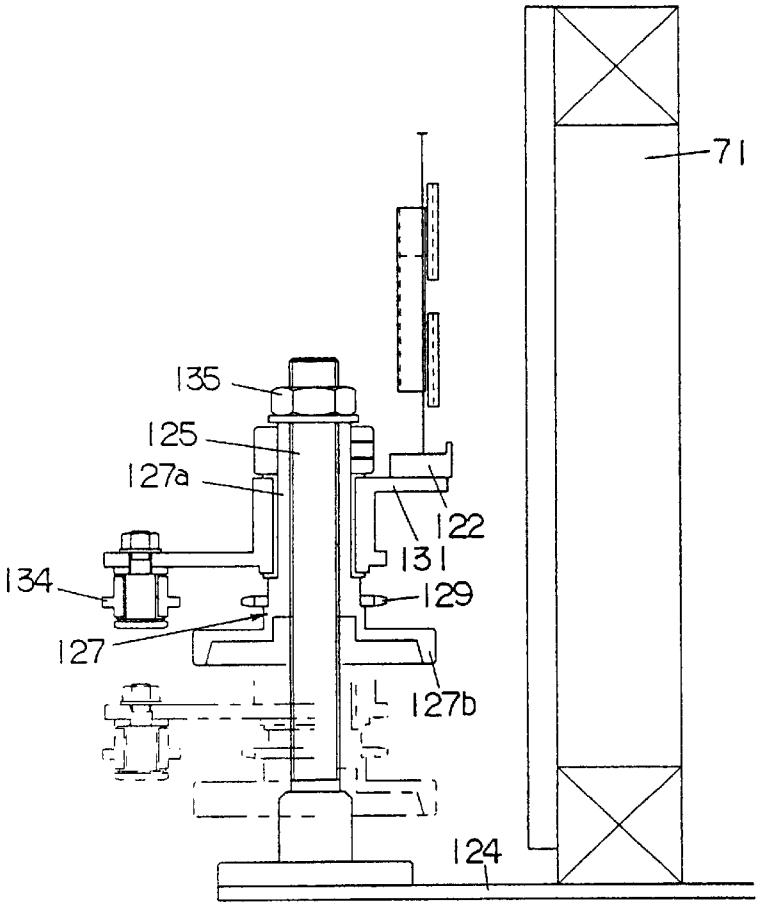
FIGS. 7A and 7B are sectional views of the height adjustment means of the bag (container) bottom receiving stand on the container (packing bag) exit side.
Figure 7A:
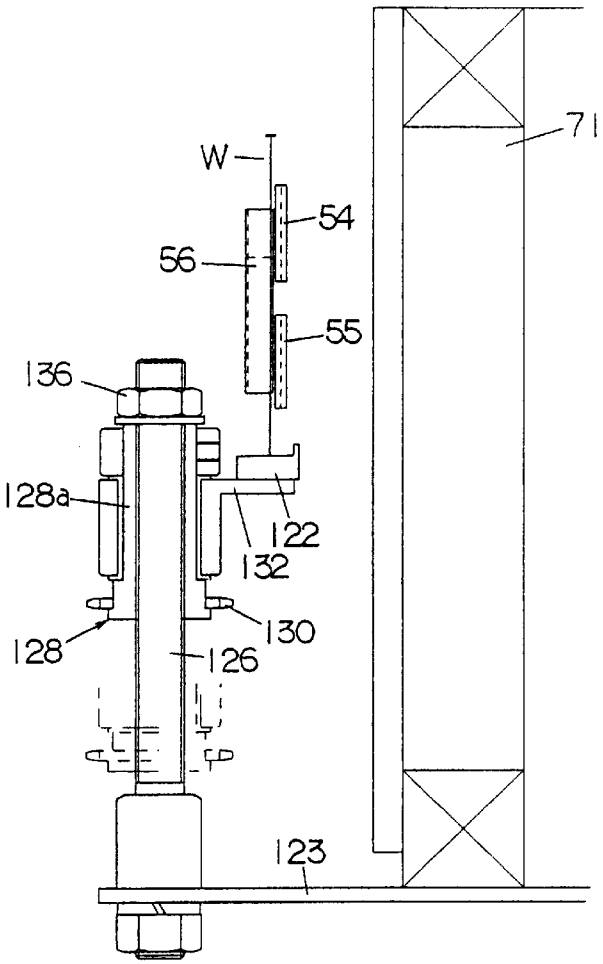

FIGS. 7A and 7B show the bag bottom receiving stand 122 disposed on the bag exit side B, and the height adjustment means for the bag bottom receiving stand 122 (these elements are also shown in FIG. 1). The bag bottom receiving stand 122 is disposed as a continuation of the bag bottom receiving stand 106. The bag bottom receiving stand 122 guides the movement of the bags held by the bag holding assemblies 56.

Supporting shafts 125 and 126 which have external screws formed on their outer circumferences are respectively installed in upright positions on plates 123 and 124 disposed on the frame 71. An adjustment member 127 which has a tubular part 127*a* with an internal screw formed inside and an adjustment handle 127*b* on its lower end is screw-engaged with the supporting shaft 125, and a driven member 128 which has a tubular part 128*a* with an internal screw formed inside is screw-engaged with the supporting shaft 126. Sprockets 129 and 130 are fastened to the outer circumferences of the respective tubular parts 127*a* and 128*a*. Furthermore, attachment holders 131 and 132 to which the bag bottom receiving stand 122 is attached are fitted over the circumferences of the respective tubular parts 127*a* and 128*a* so that the attachment holders 131 and 132 are rotatable relative to the tubular parts 127*a* and 128*a*. A tension roller 134 which applies tension to a chain 133 mounted on the sprockets 129 and 130 is rotabably mounted on the attachment holder 131.

When the lock nuts 135 and 136 are loosened and the adjustment handle 127*b* is rotated, the attachment holders 131 and 132 can be raised and lowered, so that the height of the bag bottom receiving stand 122 can be adjusted. Furthermore, a fixed upper conveying guide and a lower conveying guide that can be raised and lowered are installed in the vicinity of the rotary type transfer device 69 as continuations of the upper and lower conveying guides 107 and 108; however, these elements are not shown.

Figure 8:
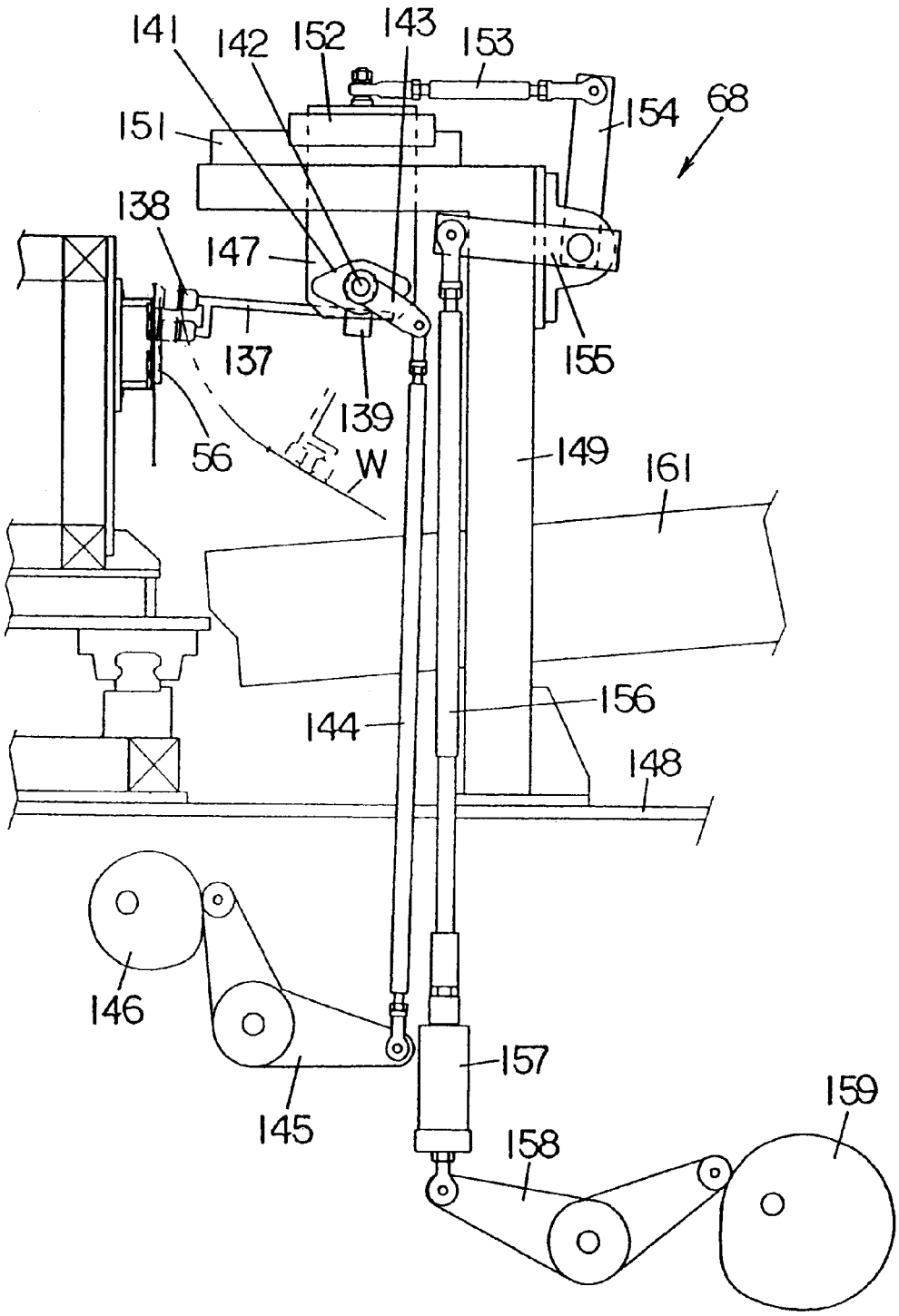
FIG. 8 is a side view of the intermittent bag-supplying (container-supplying) device equipped with an interference-preventing device.

The intermittent bag-supplying device 68 of the continuous bag-supplying apparatus is shown in FIG. 8. The intermittent bag-supplying device 68 differs from the intermittent bag-supplying device 5 of the above-described conventional apparatus. The intermittent bag-supplying device 68 is installed on the bag entry side A with a chucking swinging arm 137 that advances and retracts with respect to the bag holding assemblies 56. Also, the reference position for this advancing and retracting action can be altered. In all other respects, the intermittent bag-supplying device 68 is the same as the intermittent bag-supplying device 5.

The chucking swinging arm 137 has suction plates 138 on its tip end, and the rear end of the chucking swinging arm 137 is attached to a swinging lever 139. The swinging lever 139 is fastened to a fulcrum shaft 142 supported by a bearing 141. The fulcrum shaft 142 is fastened to an intermediate swinging lever 143, and pivots in accordance with the rotation of a swinging cam 146 via a raising-and-lowering rod 144 and cam lever 145, so that the chucking swinging arm 137 is caused to swing with a specified timing.

The bearing 141 is attached to the lower end of an advancing-and-retracting plate 147. The advancing-and-retracting plate 147 has a slider 152 which slides along an advancing-and-retracting rail 151 disposed on a stand 149 which is installed in an upright position on a bed 148. The advancing-and-retracting plate 147 is installed so that it is free to advance and retract with respect to the bag holding assemblies 56. The advancing-and-retracting plate 147 is caused to advance and retract in accordance with the rotation of an advancing-and-retracting cam 159 via a connecting rod 153, swinging lever 154, intermediate swinging lever 155, raising-and-lowering rod 156, interference-preventing air cylinder 157 and cam lever 158.

In the intermittent bag-supplying device 68, as in the conventional apparatus, bags or containers that have been conveyed on the belt conveyor 161 and stopped as a result of contacting a stopper are chucked and lifted a specified distance by the suction plate on a chucking extraction arm (not shown). Then, the bags are chucked by the suction plates 138 of the chucking swinging arm 137 (two-dotted (imaginary) line), and the arm 137 swings upward (solid line). After this, the advancing-and-retracting plate 147 is caused to advance so that the bags are fed into the longitudinal spaces or grooves 56*a* of the bag holding assemblies 56 (two-dotted (imaginary) line). The interference-preventing air cylinder 157 is ordinarily a retracted. However, when the rod of the air cylinder 157 is extended, the reference position of the advancing-and-retracting action of the advancing-and-retracting plate 147 is withdrawn from the ordinary position. Thus, even if the advancing-and-retracting plate 147 advances to the maximum extent with the rotation of the advancing-and-retracting cam 159, the suction plates 138 on the tip end of the chucking swinging arm 137 do not reach the bag holding assemblies 56.

The intermittent bag-supplying device 68 is structured as described above. The reason for this structure is as follows: when the centers are automatically corrected following the adjustment of the spacing between the right-side and left-side holding members 57 and 58 of the continuous bag-supplying apparatus, or immediately following a change in the operating speed or during stopping or starting, etc., there may be cases in which the timing of the movement of the bag holding assemblies 56 and the operating timing of the chucking swinging arm 137 are thrown off, resulting in that the bag holding assemblies 56 and suction plates 138 interfere with each other and are damaged. This must be avoided, and this is the reason for the above structure of the intermittent bag-supplying device 68.

Likewise, there may also be cases in which the timing of the movement of the bag holding assemblies 56 and the operating timing of the rotary type transfer device 69 are thrown off, so that the bag holding assemblies 56 and transfer means interfere with each other and are damaged. Means for forcibly avoiding of such interfere and damages are shown in FIGS. 9A, 9B and 10.

Figure 9A:
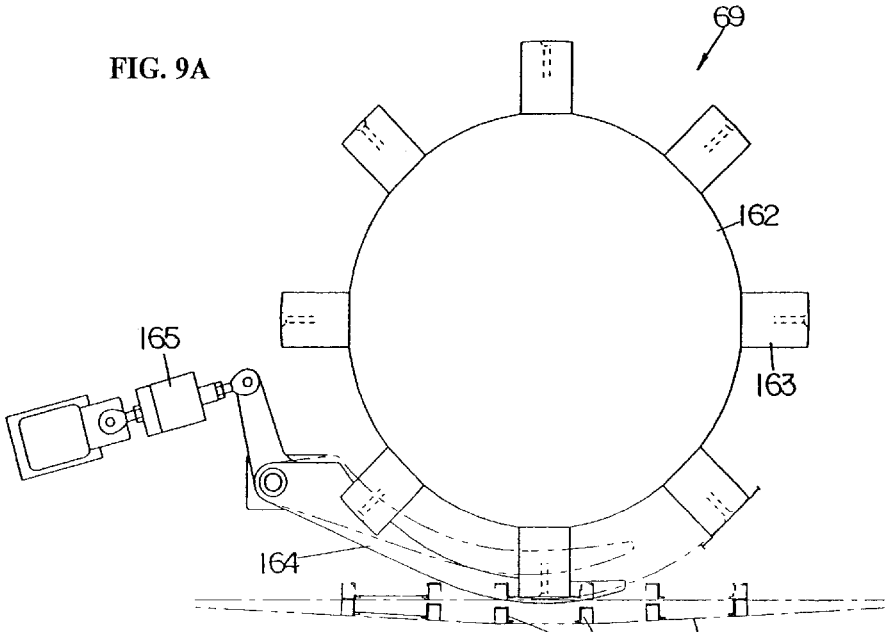
FIG. 9A is a top view of the rotary type transfer device equipped with an interference-preventing device.
Figure 9B:
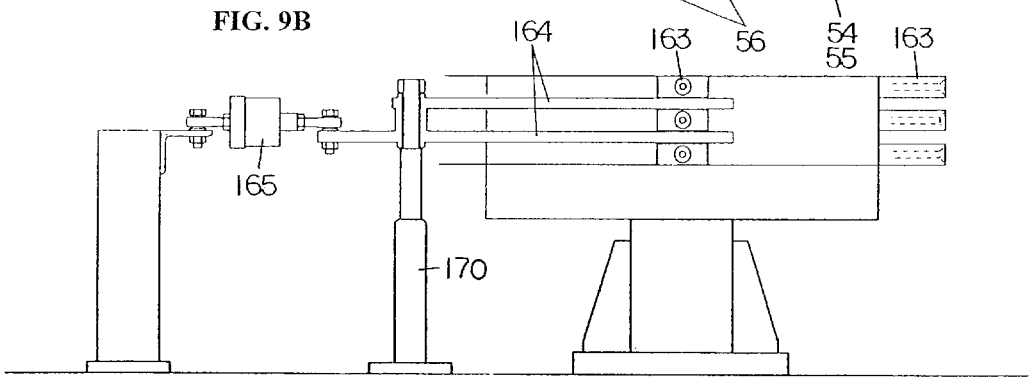
FIG. 9B is a side view thereof.

In FIGS. 9A and 9B, transfer means are disposed at equal intervals on the circumference of the rotor 162 of the rotary type transfer device 69, and a fork-shaped interference-preventing arm 164 which has a substantially circular-arc-form shape and which is supported on a stand 170 so that the arm 164 is pivotable in the horizontal plane is disposed between the rotor 162 and the conveying track of the bag holding assemblies 56. The interference-preventing arm 164 is positioned between the respective stages of the transfer means 163 which are formed in three stages above and below. Ordinarily, the interference-preventing arm 164 waits in a retracted position on the inside as indicated by the two-dotted (imaginary) line in FIGS. 9A and 9B. However, when the rod of the air cylinder 165 extends, the interference-preventing arm 164 pivots into the forward operating position indicated by the solid line, and pushes the bag holding assemblies 56 so that the upper and lower conveyor belts 54 and 55 are bent toward the inside, thus forcibly preventing interference between the bag holding assemblies 56 and the transfer means 163.

Figure 10A:
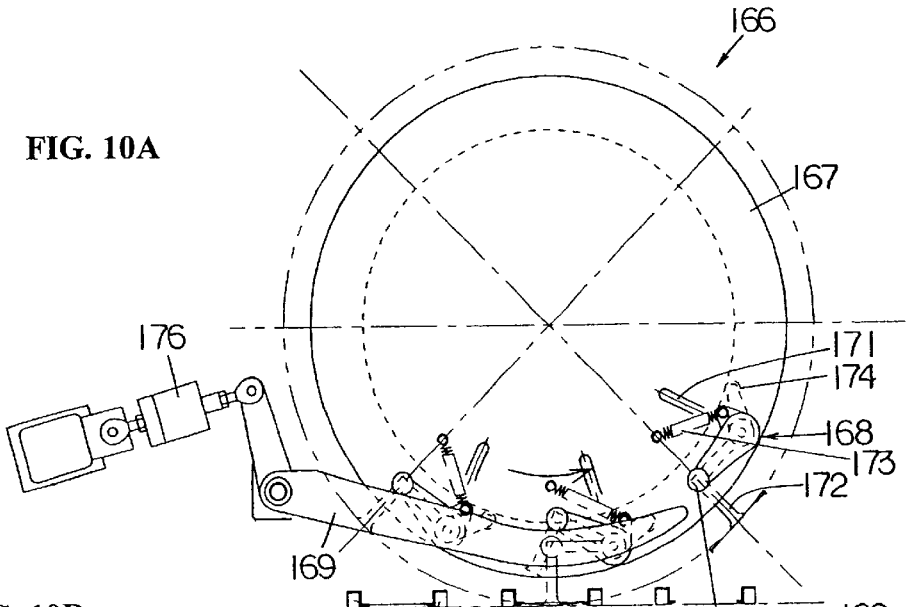
FIG. 10A is a top view of the rotary type transfer device equipped with an interference-preventing device.
Figure 10B:
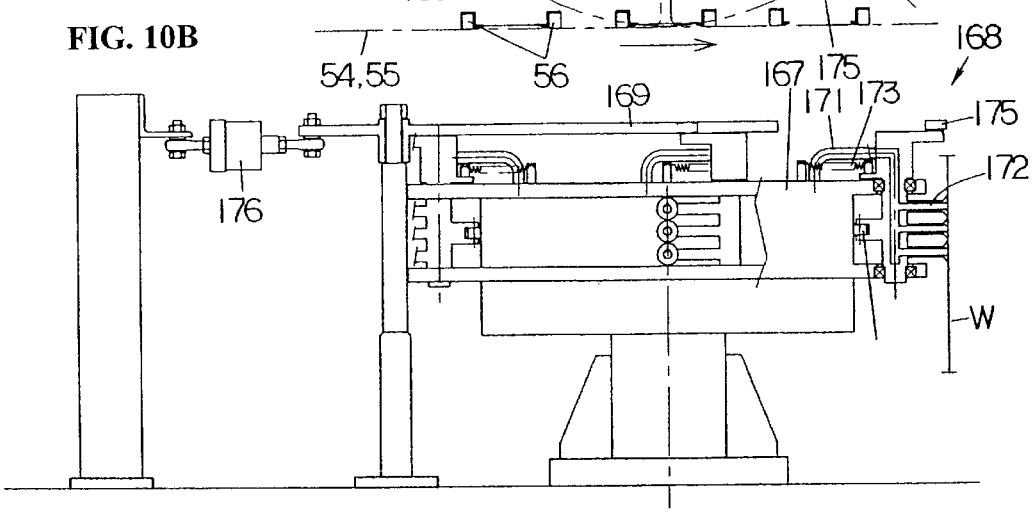
FIG. 10B is a side view thereof.
Figure 11:
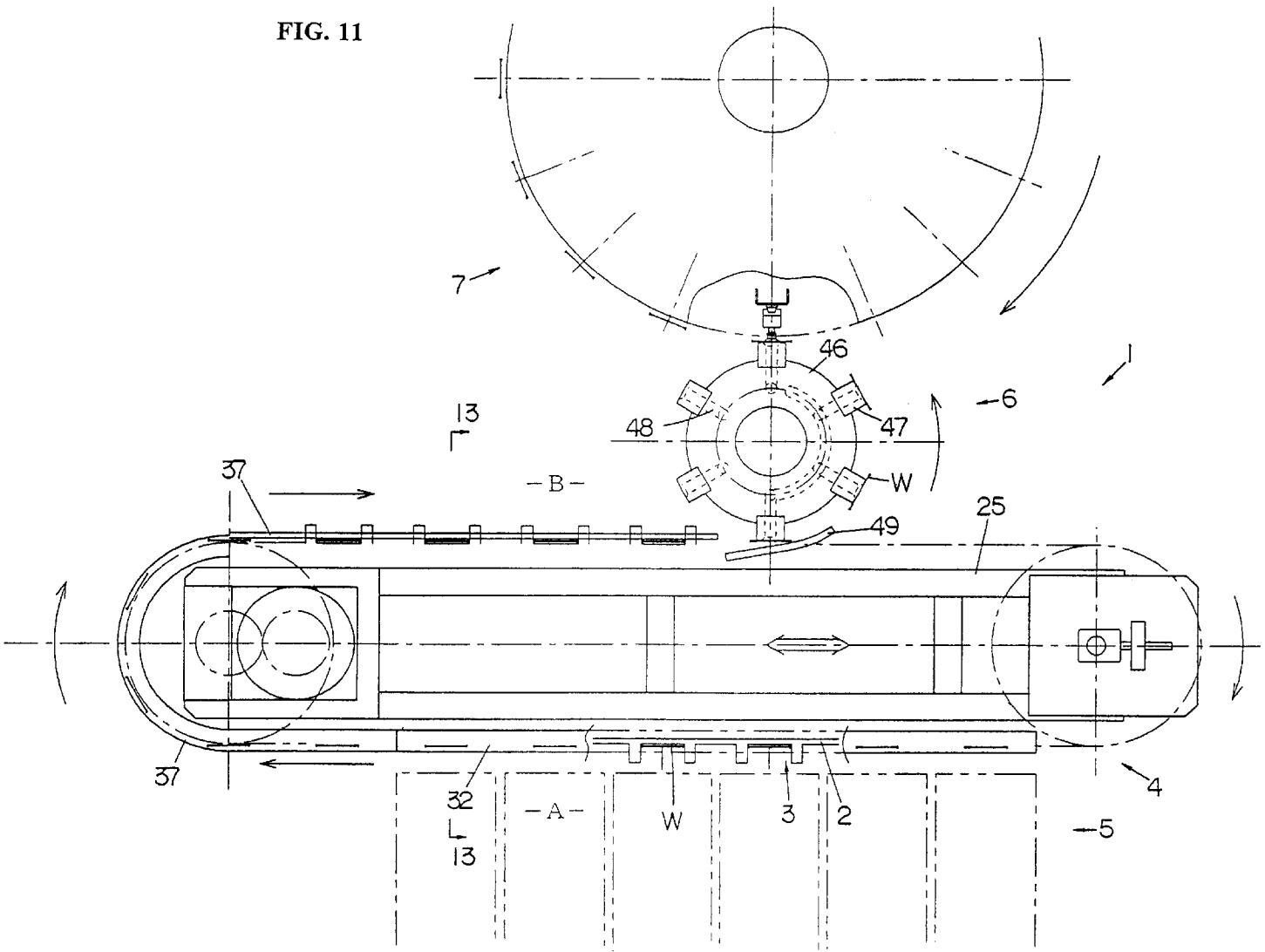
FIG. 11 is a top view of a conventional continuous bag-supplying apparatus.
Figure 12:
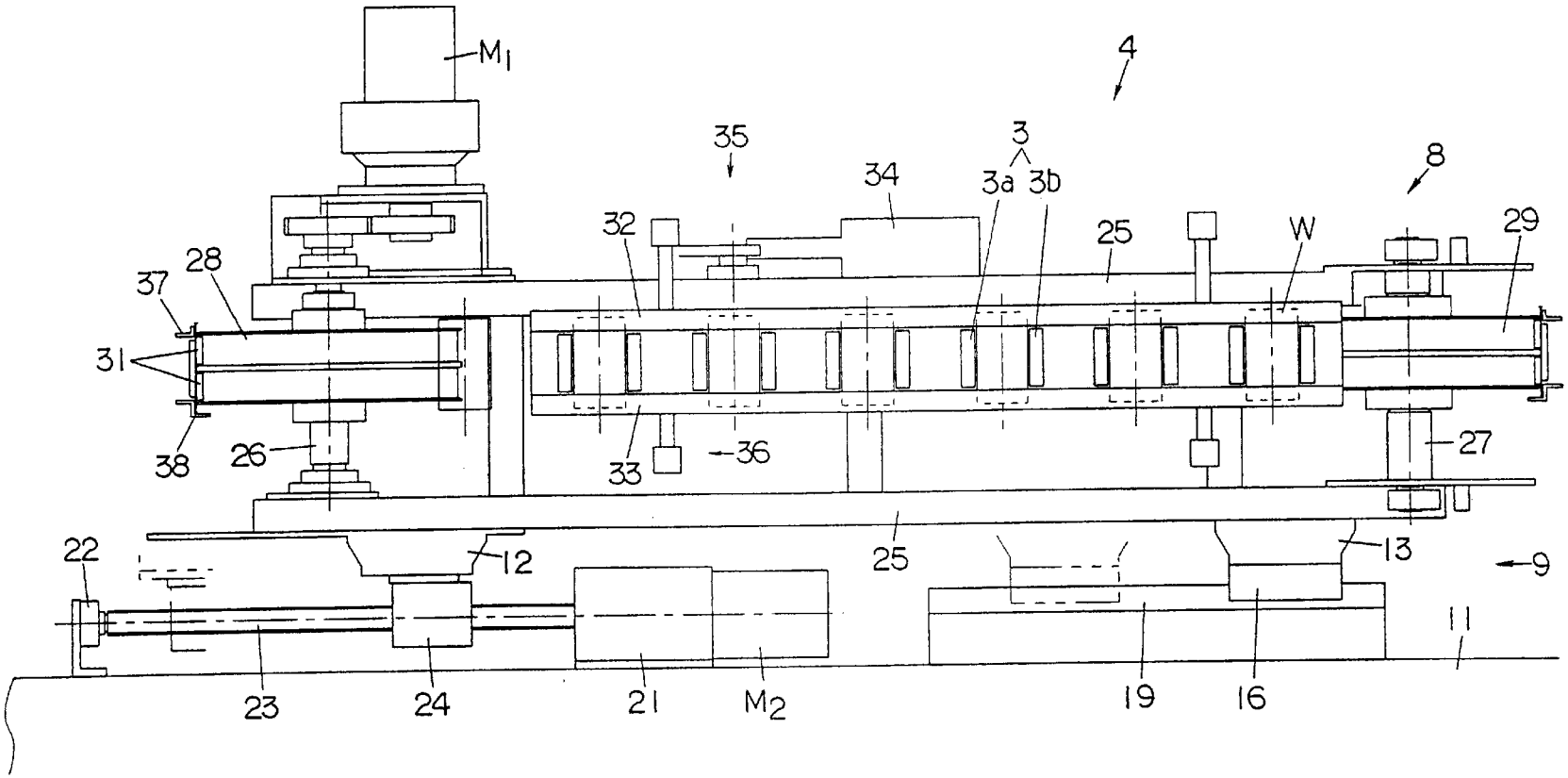
FIG. 12 is a side view of the bag holding assembly conveying device of the conventional continuous bag-supplying apparatus.
Figure 13:
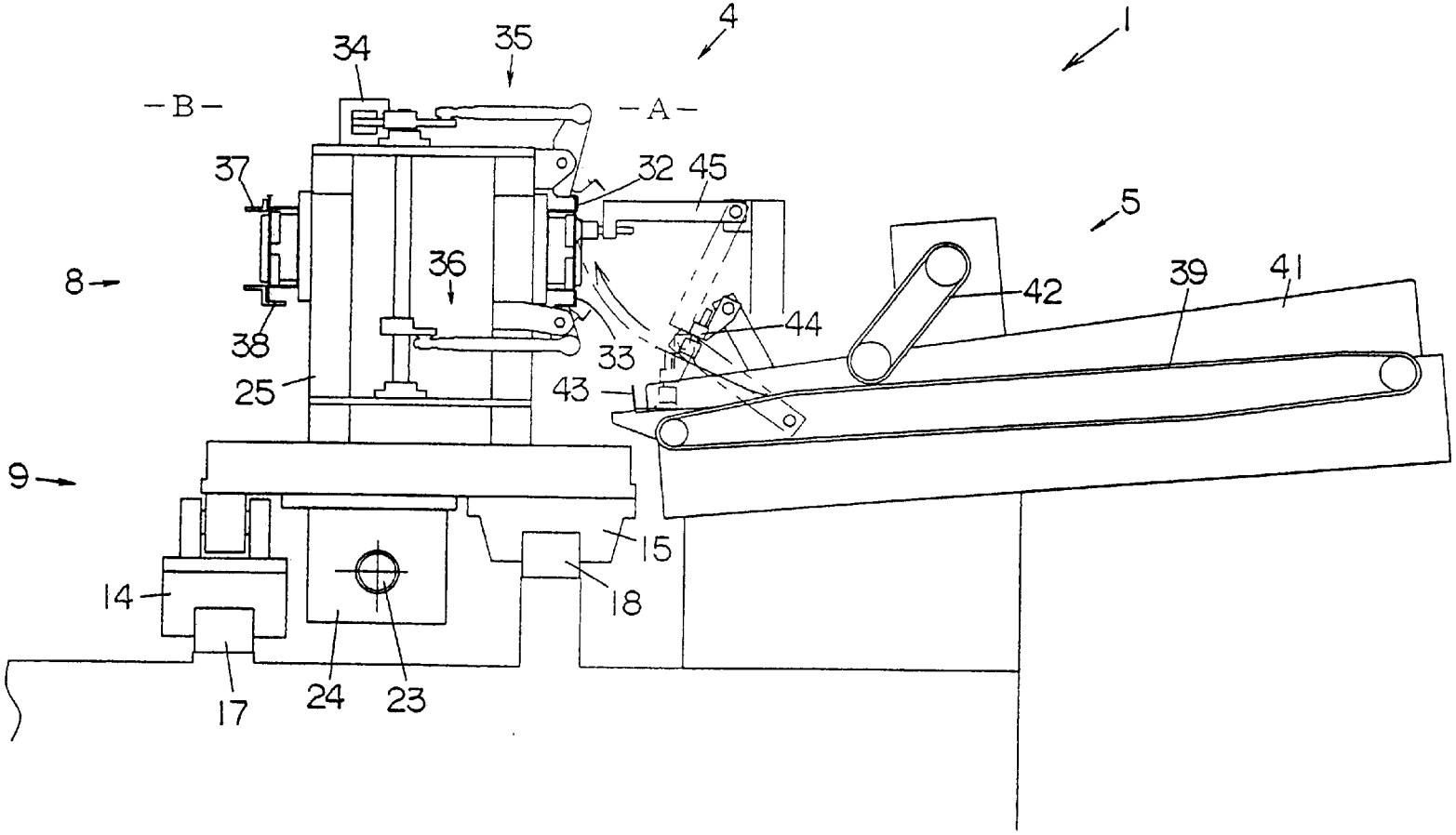
FIG. 13 is a sectional view taken along the line 13—13 in FIG. 11.
Figure 14:
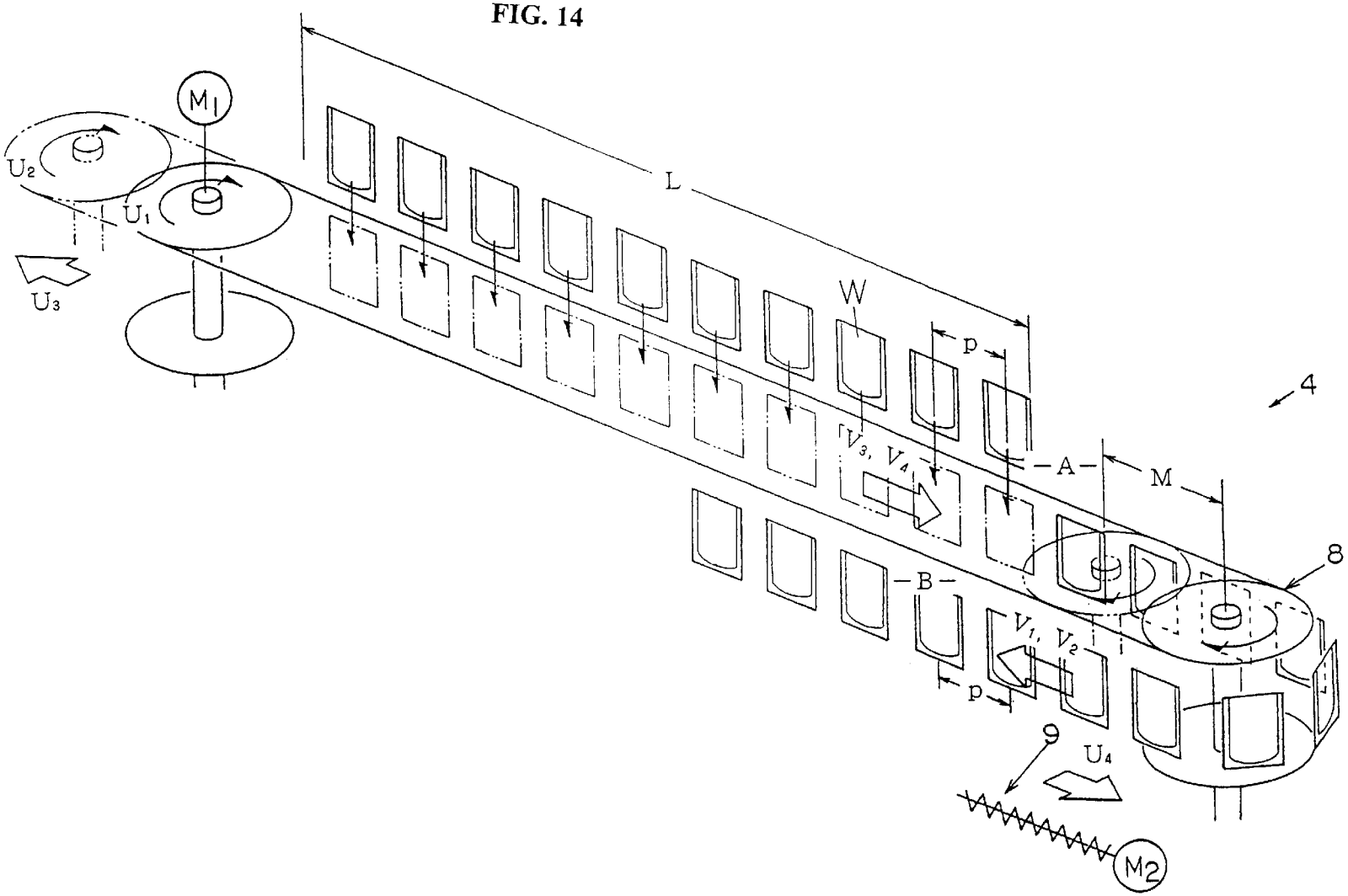
FIG. 14 is a schematic diagram illustrating the function of the conventional continuous bag-supplying apparatus.
Figure 15:
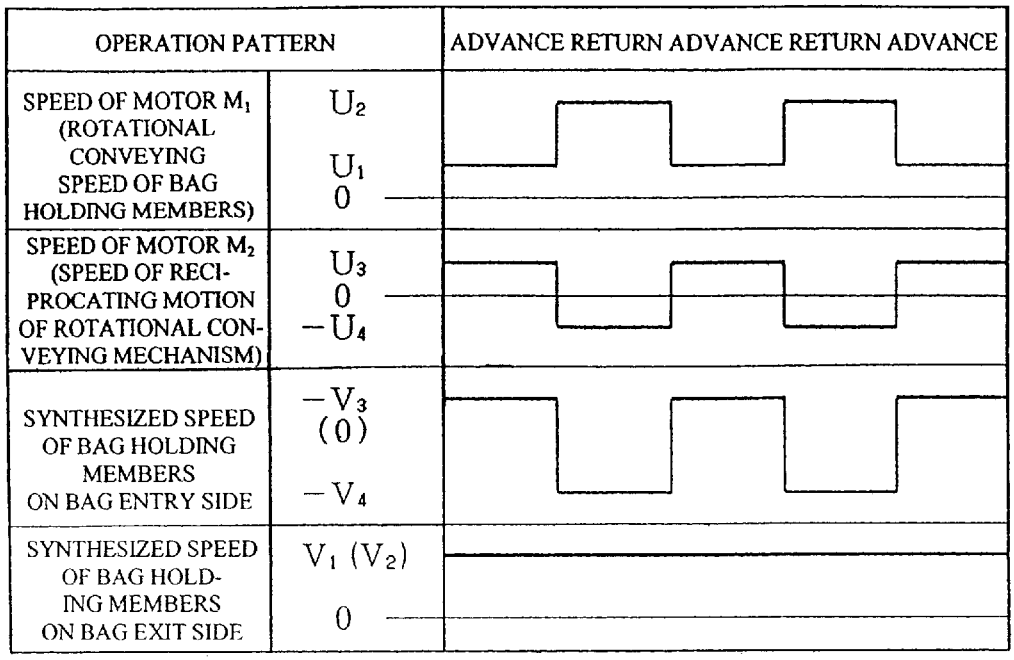
FIG. 15 illustrates the operating pattern of the conventional bag holding assembly conveying device.

Furthermore, FIGS. 10A and 10B illustrate a different system.

In FIGS. 10A and 10B, the transfer means 168 disposed on the circumference of the rotor 167 of the rotary type transfer device 166 are pulled inward toward the center by an interference-preventing arm 169 disposed on the upper part of the rotor 167. The transfer means 168 are supported so that they are free to rotate on the circumference of the rotor 167, and are connected to the rotor 167 by flexible vacuum tubing 171. The transfer means 168 have vacuum suction parts 172 that face radially outward. Springs 173 which apply a rotational force to the transfer means 168 so that the vacuum suction parts 172 are pushed radially outward are attached between the transfer means 168 and the rotor 167, and the positions of the vacuum suction parts 172 in the radial direction are regulated by stopper rollers 174 that run over the outer circumferential surface of the rotor 167. Furthermore, rollers 175 that contact the interference-preventing arm 169 are attached to the upper parts of the transfer means 168.

The interference-preventing arm 169 is positioned at the same height as the rollers 175 on the upper part of the rotor 167. Ordinarily, the interference-preventing arm 169 waits in a retracted position which is near the conveying track of the bag holding assemblies 56 in front, but which is such that the interference-preventing arm 169 does not contact the rollers 175. However, when the rod of the air cylinder 176 is retracted, the interference-preventing arm 169 pivots toward an operating position located to the rear, and contacts the rollers 175 so that the transfer means 168 are caused to pivot, thus pushing the vacuum suction parts 172 inward in the radial direction, so that interference between the bag holding assemblies 56 and the transfer means 168 (vacuum suction parts 172) is forcibly avoided.

As seen from the above, according to the present invention, in a continuous container-supplying apparatus in which containers are intermittently supplied in a plurality of rows and then converted into a continuous motion in a single row so that containers are continuously supplied to a continuous filling and packaging system, containers of different dimensions and shapes can be supplied reliably and smoothly.

What is claimed is:

1. A continuous container-supplying apparatus comprising a container holding assembly conveying device and a container-supplying device, wherein said container holding assembly conveying device comprises a plurality of container holding assemblies that are disposed at equal intervals so as to be moved in one direction along an annular track which has a pair of parallel sections, said container holding assemblies being moved, on a first side of said parallel sections, intermittently in an action in which a distance of said intermittent movement is an integral multiple of an attachment spacing of said container holding assemblies, and said container holding assemblies being moved, on a second side of said parallel sections, continuously at a constant speed;

said container-supplying device simultaneously supplies a plurality of containers respectively to each of said plurality of container holding assemblies on said first side of said parallel sections;

said continuous container-supplying apparatus supplies, by way of said container-supplying device, said containers in plurality of rows to said container holding assemblies that are stopped on said first side of said parallel sections, and said continuous container-supplying apparatus successively removes said containers from continuously moving container holding assemblies on said second side of said parallel sections;

each of said container holding assemblies is:

comprised of a right-side holding member and a left-side holding member that hold each of said containers between said right-side holding member and left-side holding member;

provided at equal intervals on conveying bodies that run along said annular track; and adjustable in regards to spacing between said right-side and left-side holding members thereof;

each of said container holding assemblies is mounted on outside surfaces of said conveying bodies so as to hold a packing bag; and said right-side and left-side holding members of said each of said container holding assemblies comprises:

guide portions tat hold left and right edges of said packaging bag, and back surface portions that are formed so as to face inwardly along said conveying bodies and extend from said guide portions; and wherein said packing bag is held in a space defined by said guide portions and back surface portions of said fight-side and left-side holding members.

2. A continuous container-supplying apparatus comprising a container holding assembly conveying device and a container-supplying device, wherein said container holding assembly conveying device comprises a plurality of container holding assemblies that are disposed at equal intervals so as to be moved in one direction along an annular track which has a pair of parallel sections, said container holding assemblies being moved, on a first side of said parallel sections, intermittently in an action in which a distance of said intermittent movement is an integral multiple of an attachment spacing of said container holding assemblies, and said container holding assemblies being moved, on a second side of said parallel sections, continuously at a constant speed;

said container-supplying device simultaneously supplies a plurality of containers respectively to each of said plurality of container holding assemblies on said first side of said parallel sections;

said continuous container-supplying apparatus supplies, by way of said container-supplying device, said containers in a plurality of rows to said container holding assemblies that are stopped on said first side of said parallel sections, and said continuous container-supplying apparatus successively removes said containers from continuously moving container holding assemblies on said second side of said parallel sections;

each of said container holding assemblies is:

comprised of a right-side holding member and a left-side holding member that hold each of said containers between said right-side holding member and left-side holding member;

provided equal intervals on conveying bodies that run along said annular track; and adjustable in rewards to spacing between said right-side and left-side holding members thereof;

said conveying bodies are installed in a vertical relationship;

said left-side holding member and right-side holding member are respectively provided an either one of said conveying bodies;

a spacing adjustment means is provided so as to adjust a relative positional relationship, in regards to a running direction of said conveying bodies, between one of said conveying bodies on which said left-side holding member is provided and another one of said conveying bodies on which said right-side holding member is provided;

each of said container holding assemblies is mounted on outside surfaces of said conveying bodies so as to hold a packing bag; and said right-side and left-side holding members of said each of said container holding assemblies comprises:

guide portions that hold left and right edges of said packaging bag, and back surface portions that are formed so as to face inwardly along said conveying bodies and extend from said guide portions; and wherein said packing bag is held in a space defined by said guide portions and back surface portions of said right-side and left-side holding members.

3. A continuous container supplying apparatus comprising a container holding assembly conveying device and a container-supplying device, wherein said container holding assembly conveying device comprises a plurality of container holding assemblies tat are disposed at equal intervals so as to be moved in one direction along an annular track which has a pair of parallel sections, said container holding assemblies being moved, on a first side of said parallel sections, intermittently in an action in which a distance of said intermittent movement is an integral multiple of an attachment spacing of said container holding assemblies, and said container holding assemblies being moved, on a second side of said parallel sections, continuously at a constant speed;

said container-supplying device simultaneously supplies a plurality of containers respectively to each of said plurality of container holding assemblies on said first side of said parallel sections;

said continuous container-supplying apparatus supplies, by way of said container-supplying device, said containers in a plurality of rows to said container holding assemblies that are stopped on said first side of said parallel sections, and said continuous container-supplying apparatus successively removes said containers from continuously moving container holding assemblies on said second side of said parallel sections;

each of said container holding assemblies is:

comprised of a right-side holding member and a left-side holding member that hold each of said containers between said right-side holding member and left-side holding member;

provided at equal intervals on conveying bodies that run along said annular track; and adjustable in regards to spacing between said right-side and left-side holding members thereof;

said conveying bodies are installed in a vertical relationship;

said left-side holding member and right-side holding member are respectively provided on either one of said conveying bodies;

a spacing adjustment means is provided so as to adjust a relative positional relationship, in regards to a running direction of said conveying bodies, between one of said conveying bodies on which said left-side holding member is provided and another one of said conveying bodies on which said right-side holding member is provided;

each of said container holding assemblies is comprised of a pair of said right-side and left-side holding members;

two of said conveying bodies are disposed one on the other;

said left-side and right-side holding members are respectively mounted on either one of said two conveying bodies;

each of said container holding assemblies is mounted on outside surfaces of said conveying bodies so as to hold a packing bag; and said right-side and left-side holding members of each of said container holding assemblies comprises:

guide portions that hold left and right edges of said packing bag, and back surface portions that are formed so as to face inwardly along said conveying bodies and extend from said guide portions; and wherein said packing bag is held in a space defined by said guide portions and back surface portions of said right-side and left side holding members.

* * * * *